US005671917A

United States Patent [19]

Choho et al.

[11] Patent Number: 5,671,917

[45] Date of Patent: Sep. 30, 1997

[54] ORIGINAL CONVEY APPARATUS WITH LAST ORIGINAL DETECTION SENSOR

[75] Inventors: Satoshi Choho, Tokyo; Akimaro Yoshida; Katsuaki Hirai, both of Yokohama; Shuichi Yabe, Kawasaki, all of Japan

[73] Assignees: Canon Aptex Inc., Mitsukaido; Canon Kabushiki Kaisha, Tokyo, both of Japan

[21] Appl. No.: 634,889

[22] Filed: Apr. 22, 1996

Related U.S. Application Data

[63] Continuation of Ser. No. 81,219, Jun. 25, 1993, abandoned.

[30] Foreign Application Priority Data

Jun. 26, 1992 [JP] Japan ..... 4-193116

[51] Int. Cl.[6] ..... B65H 7/08

[52] U.S. Cl. ..... 271/111; 271/110; 271/171; 271/285.01; 271/259; 271/265.02; 271/3.01

[58] Field of Search ..... 271/3.01, 11, 111, 271/171, 258.01, 259, 265.02

[56] References Cited

U.S. PATENT DOCUMENTS

| | | | |
|---|---|---|---|
| 4,164,347 | 8/1979 | McGrain | 271/3.1 |
| 4,723,772 | 2/1988 | Honjo et al. | 271/3.1 |
| 4,727,398 | 2/1988 | Honjo et al. | 355/3 |
| 4,761,001 | 8/1988 | Hayakawa et al. | 271/3.1 |
| 4,815,722 | 3/1989 | Sugimoto | 271/3.1 |
| 5,018,714 | 5/1991 | Honjo et al. | 271/3.1 |
| 5,018,716 | 5/1991 | Yoshida et al. | 271/227 |
| 5,181,706 | 1/1993 | Yamamoto et al. | 271/11 |

*Primary Examiner*—William E. Terrell
*Assistant Examiner*—Khoi H. Tran

[57] ABSTRACT

The present invention provides an original convey apparatus with an original tray on which originals are rested, a conveyor for conveying the original on the original tray, a last original detector for detecting the fact that all of the originals on the original tray are conveyed, and original size information detector. Wherein an original detector position for the last original detection is changed on the basis of original size information.

14 Claims, 22 Drawing Sheets

FIG. 4B MAX. SIZE

FIG. 4C MIN. SIZE

FIG. 7B PRIOR ART MAX. SIZE

FIG. 7C PRIOR ART MIN. SIZE

ORIGINAL CONVEY APPARATUS WITH LAST ORIGINAL DETECTION SENSOR

This application is a continuation of application Ser. No. 08/081,219 filed Jun. 25 1993, now abandoned.

BACKGROUND OF THE INVENTION

1. Field of the Invention

The present invention relates to an original convey apparatus having a last original detection sensor, and an image forming apparatus having an original convey apparatus, wherein the supply of a recording medium is controlled by such detection means.

2. Related Background Art

In the past, image forming apparatuses having a circulating original convey apparatus (referred to merely as "original convey apparatus" hereinafter) are known. In such an image forming apparatus, a platen for resting an original to be read is arranged on a top surface of a frame of the image forming apparatus so that an original is automatically fed onto the platen by the original convey apparatus, and the original is automatically removed from the platen by the original convey apparatus after it was read and a next new original is set on the platen.

FIG. 5 is an elevational sectional view of such original convey apparatus.

Originals or documents D are set on an original tray 201 in such a manner that tip ends of the originals are abutted against an original stopper 202, and a semi-circular roller 203 is rotated. A lowermost original D is conveyed to a nip between a separation belt 209 extending between a pair of separation rollers 207, 208 and an original supply roller 206 while being regulated by a separation regulating plate 205, thereby separating the lowermost original alone. The separated original D is guided by upper and lower guides 210, 213 to reach a nip between a reverse rotation roller 212 and a regist roller 211. Thereafter, the original D passes through an intermediate guide 214 and then is set on a platen 215 by a convey belt 218 mounted on a drive roller 216, a driven roller 217 and a plurality of auxiliary rollers 219 on the platen 215. An image on original D so set is read by light from a light source (not shown). Then, the original is conveyed along a jump member 220 and a lower guide 221 by the reverse rotation of the convey belt 218, and is then passed between an upper surface of a flapper 223 and an upper surface of the upper guide 210 and a lower surface of an opening/closing guide 222 by the reverse rotation roller 212, and then is discharged onto the original tray 201 by a pair of discharge rollers 224.

Incidentally, when an original D having both imaged surfaces is copied, after one imaged surface of the original is copied, by switching the flapper 223, the original D is set on the platen 215 again with the upper and lower surfaces turned up by the convey belt 218, and an image of the other surface (lower surface) of the original is read.

The operation of various elements and the convey operation of the original D are controlled by various sensors disposed in an original convey path. For example, a separation sensor S2 disposed at a downstream side of the separation belt 209, a regist sensor S3 disposed an upstream side of the regist roller 211, a reverse rotation sensor S4 disposed below the reverse rotation roller, and a sheet discharge sensor S5 disposed at an upstream side of the paired discharge rollers 224 are provided.

Further, as one of the sensors, a last original detection means is arranged above the original tray 201. As shown in FIGS. 6A and 6B, this detection means is constituted by a sensor S6 of permeable type having a light emitting portion and a light receiving portion, and a recycle lever 225 for blocking a light path of the sensor S6 by its own rotation. The detection means is held on the uppermost original D and serves to detect the presence/absence of the uppermost original D (cycle end original) until the lowermost original D is fed from the original tray 201 and is exposed on the platen 215 and is returned on the original tray 201 again.

Normally, the recycle lever 225 is positioned with respect to the sensor S6 as shown in FIG. 6A. When a copy start command is emitted, as shown in FIG. 6B, the recycle lever 225 is rotated in a direction shown by the arrow by a motor (not shown), so that it is positioned on the uppermost original D. Then, when the lowermost original D is rested on the original tray 201 again, as shown in FIG. 6C, the lowermost original D is rested on the recycle lever 225. In this way, the conveyance of the original D is repeated. When the conveyance is repeated, the recycle lever 225 is gradually lowered, and, eventually, the recycle lever is returned to the condition shown in FIG. 6A. By sensing the position of the recycle lever 225 by the sensor S6, the cycle end is detected.

Next, a timing for transmitting the cycle end of the original stack from the original convey apparatus to the image forming apparatus will be explained.

In an image forming apparatus as shown in FIG. 8, referring to a transfer sheet $P_1$ on which an image is now formed, a next transfer sheet $P_2$ and a transfer sheet $P_3$ next to the transfer sheet $P_2$, in order to improve the copying ability, it is necessary to reduce a distance between the sheets $P_1$ and $P_2$ and a distance between the sheets $P_2$ and $P_3$. In this case, however, if the transfer sheet is supplied in a condition that it is not judged whether non-treated originals D as well as the original being treated are two or more in the original convey apparatus, the number of the originals will differ from the number of the transfer sheets.

Thus, in the modern systems, for example, when the original corresponding to the transfer sheet $P_1$ is $D_1$, the original corresponding to the transfer sheet $P_2$ is $D_2$ and the original corresponding to the transfer sheet $P_3$ is $D_3$, at a point that the original $D_2$ becomes a waiting condition before the image formation, a detection signal for the original before last one (whether there is the original $D_3$ or not) is sent to the image forming apparatus, whereby the image forming apparatus must determine whether the transfer sheet $P_3$ should be supplied or not.

Incidentally, in FIG. 8, the reference numerals 100, 102 denote sheet supply cassettes; 101, 103, 109 denote sheet supply rollers; 105, 110 denote convey rollers; 106 denotes a pair of regist rollers; 112 denotes a photosensitive drum; 113 denotes an exposure means; 114 denotes a developing device; 115 denotes a transfer charger; 116 denotes a separation charger; 117 denotes a convey belt; 118 denotes a fixing device; 119 denotes a pair of convey rollers; 120 denotes a flapper; 121 denotes a pair of sheet discharge rollers; 122 denotes bins; and 201 to 215 denote elements for re-supplying the transfer sheet to the photosensitive drum 112. Further, the reference numeral 130 denotes the original convey apparatus; 130*a* denotes an original tray; 130*b* denotes a separation belt; 130*c* denotes an original convey path; 131 denotes a platen; and 132 denotes a convey belt. When a trailing end of the transfer sheet leaves the regist rollers, a next transfer sheet is supplied from a sheet supply cassette and waits at the paired regist rollers.

However, the above-mentioned conventional technique has the following disadvantage.

FIG. 7A schematically shows the arrangement of various rollers and the positions of the original. When the n page original $D_1$ is being exposed, the (n-1) page original $D_2$ is in a pre-protrusion condition where the original is protruded from the nip between the rollers 211, 212 by a predetermined length in order to reduce the page exchanging time (FIGS. 7B and 7C). If this original is the last original D, since the trailing end of the original must escape from the recycle lever, a relation ($L_2$ is larger than maximum size, for example, LTR (216 mm)) must be satisfied (FIG. 7B).

On the other hand, if there is (n-2) page original $D_3$, the leading end of the original $D_3$ is positioned at the nip of the separation portion. In this case, since the trailing end of the original must not be escaped from the recycle lever 225, a relation ($L_1$ is smaller than minimum size, for example, STMT (139 mm)) must be satisfied (FIG. 7C). However, in order to satisfy the above two relations, in consideration of the construction of the apparatus, the separation portion including the original supply roller 206, separation belt 209 and the like must be shifted toward the recycle lever 225 (in order to reduce a distance between the separation portion and the recycle lever), thereby making the apparatus large-sized and reducing a range for detecting the original size, because, depending upon the maximum size and the minimum size, the originals of both sizes cannot be detected by the single recycle lever.

SUMMARY OF THE INVENTION

The present invention intends to eliminate the above-mentioned conventional drawback, and has an object to provide an original convey apparatus and an image forming apparatus having such original convey apparatus, wherein a last original can be surely detected without making the apparatuses large-sized even when the original is pre-fed.

In order to achieve the above object, an original convey apparatus according to the present invention is characterized in that a last original among a plurality of originals rested on an original tray can be detected at different positions corresponding to original sizes.

With this arrangement, the number of original sizes can be increased, and the apparatus can be made small-sized.

BRIEF DESCRIPTION OF THE DRAWINGS

FIGS. 4A to 4C are views showing an arrangement of the last original detection means;

FIGS. 7B and 7C are views showing positions for various original sizes;

FIG. 15 is a flow chart showing a discharge treatment;

DETAILED DESCRIPTION OF THE PREFERRED EMBODIMENTS

The present invention will now be explained in connection with embodiments thereof with reference to the accompanying drawings. Incidentally, in the illustrated embodiments, while two recycle levers are used, three or more recycle levers may be used.

Figure 1:
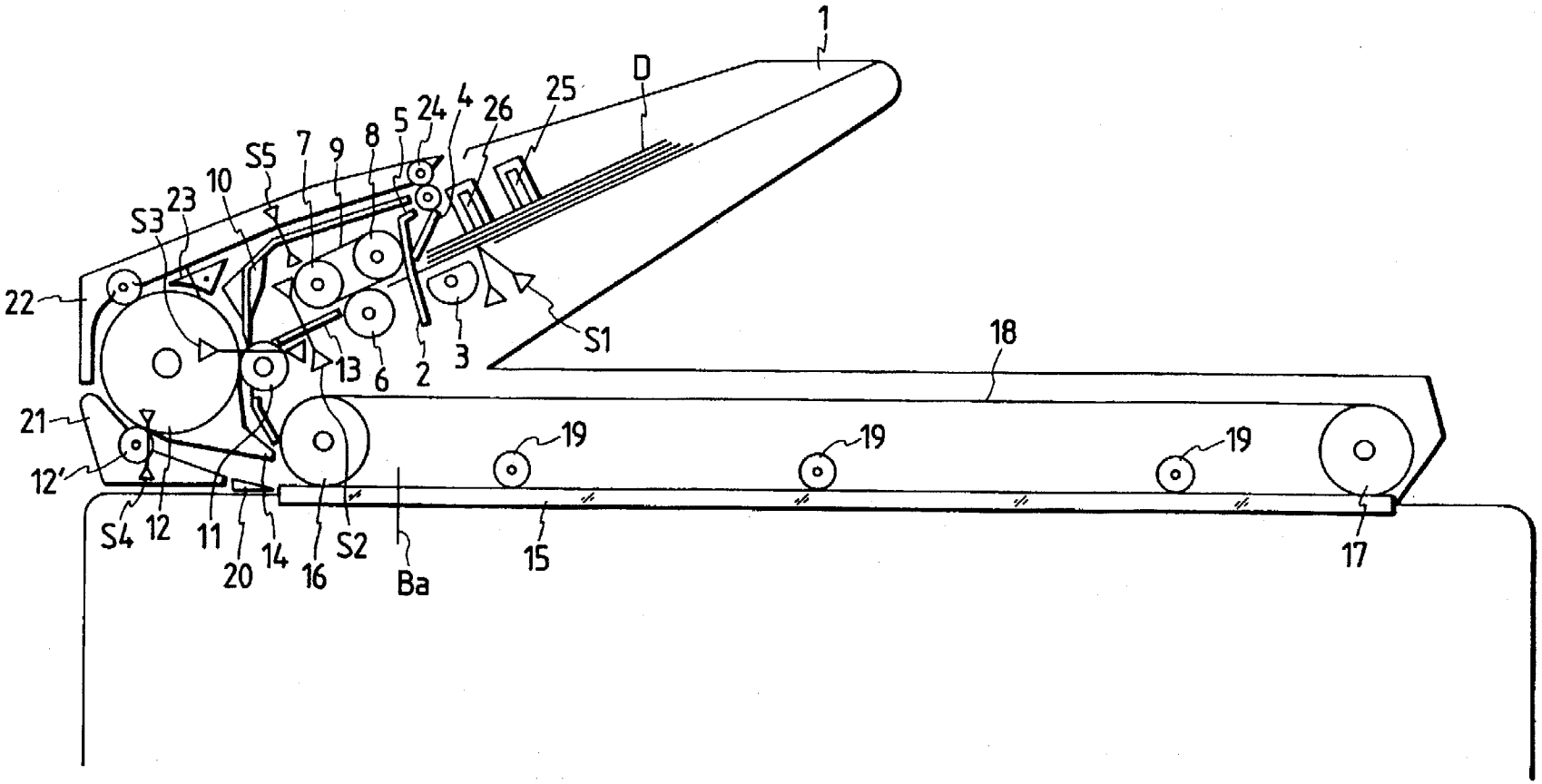
FIG. 1 is an elevational sectional view of a circulating original convey apparatus according to a preferred embodiment of the present invention.

FIG. 1 shows an image forming apparatus having a (circulating) original convey apparatus according to a preferred embodiment of the present invention. Briefly explaining the construction of the original convey apparatus, an operator sets originals D on an original tray 1 in such a manner that leading ends of the originals are abutted against an original stopper 2. A semi-circular roller 3 serves to treat the leading ends of the originals and to supply a lowermost original D. A weight 4 is provided so that, when it is difficult to feed the originals D to a separation portion, the weight is lowered to urge the original stack against the semi-circular roller 3, thereby aiding the supply of the original D. A separation regulating plate 5 serves to prevent the sliding-down of the original stack. An original supply roller 6 cooperates with a pair of separation rollers 7, 8 and a separation belt 9 to separate the lowermost original D from the original stack. A tip end of an upper guide 10 is so formed that the original D can easily enter into a regist nip between a regist roller 11 and a reverse rotation roller 12. An inner guide 13 and an intermediate guide 14 both form a convey path for the original D to direct the original to a platen 15. The original D is stopped on the platen 15 by a convey belt 18 mounted around a drive roller 16 and a driving roller 17, and a plurality of rollers 19 urging an inner surface of the convey belt. After a copying operation, the convey belt 18 is rotated reversely to shift the original along a jump member 20. Then, the original passes through a path defined by a lower guide 21 and the intermediate guide 14 and further passes between an opening/closing guide 22 and the reverse rotation roller 12 and then passes above a flapper 23 and the upper guide 10, and then is discharged onto the original tray 1 by a pair of discharge rollers 24 to be stacked again.

Incidentally, when images to be copied are formed on both surfaces of the original D, by switching the flapper 23, the original D passes below the flapper 23 and is then sent onto the platen 15 again by the regist roller 11 and the reverse rotation roller 15. In this case, the original will be turned up.

Next, various sensors for detecting the original D will be explained.

Various sensors are arranged in order along a feeding direction of the original D. These sensors are an empty sensor S1 for detecting the presence/absence of the original D on the original tray 1, a separation sensor S2 disposed immediately at a downstream side of the separation nip, a regist sensor S3 immediately at an upstream side of the nip between the regist roller 11 and the reverse rotation roller 12, a reverse rotation sensor S4 disposed in a reverse rotation path from the platen 15, and a discharge sensor S5 disposed between the reverse rotation roller 12 and the paired discharge rollers 24 to control a speed of the original D being discharged.

Next, a power transmitting system for driving various rollers will be explained.

Figure 2:
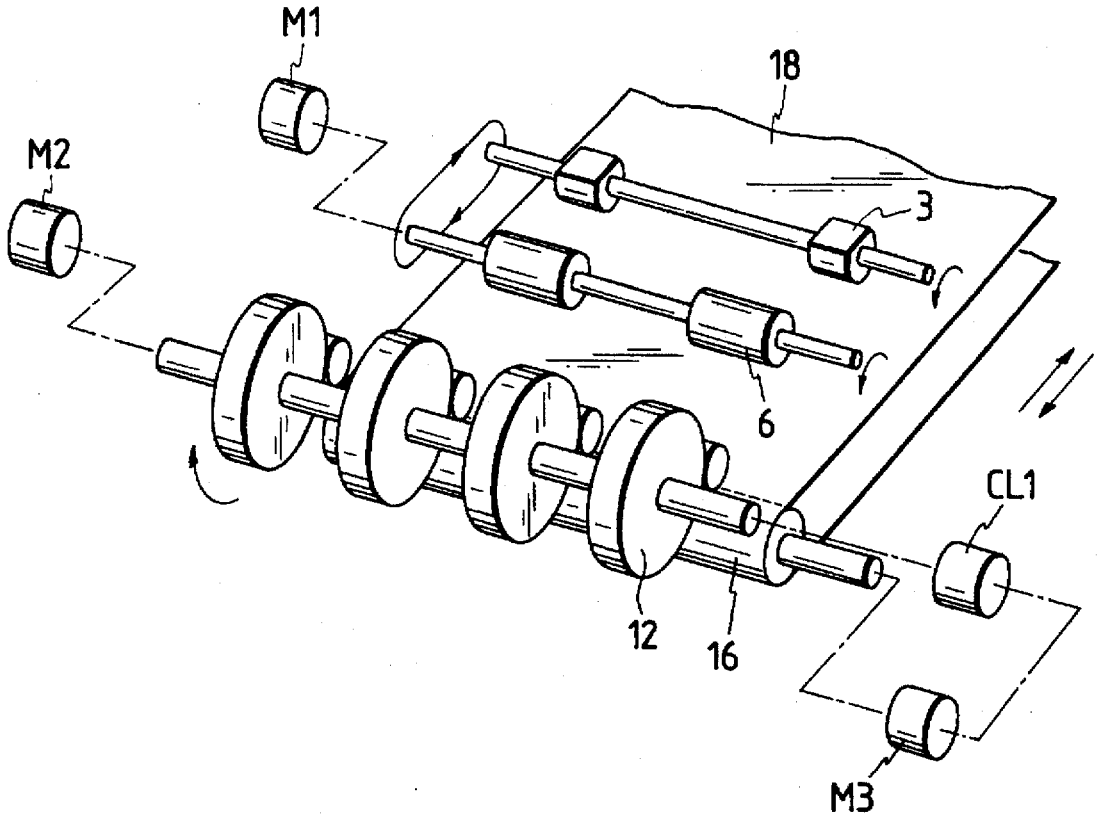
FIG. 2 is a perspective view showing a power transmitting system for driving various rollers.

As shown in FIG. 2, the power transmitting system comprises a separation motor M1 for driving the semi-circular roller 3 and the original supply roller 6, a convey motor M2 for driving the reverse rotation roller 12, a belt motor M3 for driving the drive roller 16 for driving the convey belt 18, and a clutch CL1 for synchronizing the reverse rotation roller 12 and the drive roller 16.

Figure 3:
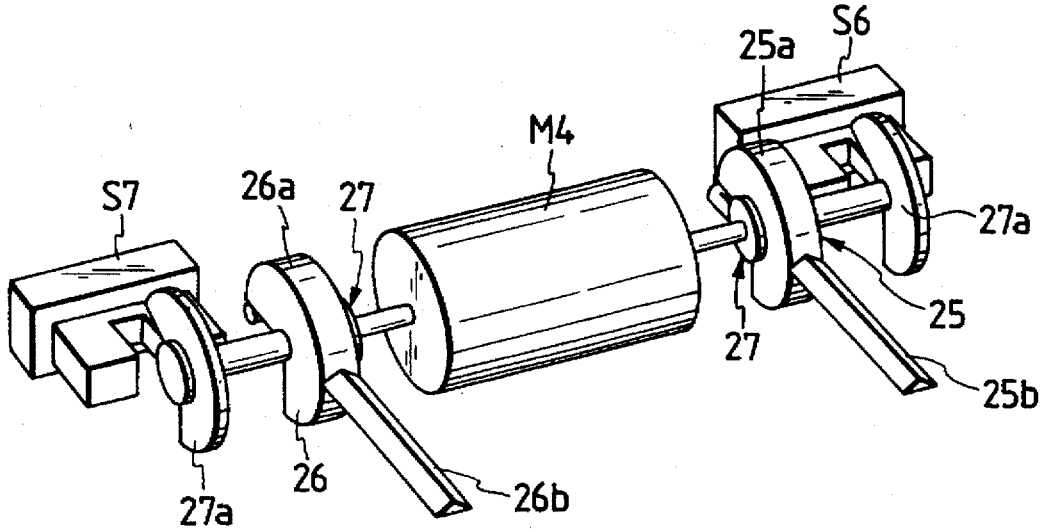
FIG. 3 is a perspective view of a last original detection means.

Next, recycle levers 25, 26 acting as a last original detection means (although these levers directly detect the last original on the original tray, since, in effect, it is checked whether the original on the platen is an original before last one or not by the levers, these levers also act as "original before last one detection means") will be fully explained with reference to FIGS. 1 and 3.

The recycle levers 25, 26 have base plates 25*a*, 26*a* each having a notch, and rod-shaped detection bars 25*b*, 26*b* protruded from the base plates, and are attached to both output shafts of a recycle motor M4 via recycle arms 27. The recycle arms 27 have flags 27*a* each having substantially the same side configuration as that of each base plate 25*a*, 26*a*. When these flags 27*a* block or unblock the light paths of recycle sensors S6, S7 of permeable type, the positions of the detection bars 25*b*, 26*b* of the recycle levers 25, 26 are detected. That is, when the detection bars 25*b*, 26*b* are rested on the uppermost original and these bars are maintained in a horizontal condition (as shown in FIG. 3), the flags 27*a* do not block the light paths of the sensors S6, S7. On the other hand, when the original becomes empty and the detection bars 25*b*, 26*b* are lowered, the flags 27*a* block the light paths, thereby detecting the fact that the original is empty.

Figure 4A:
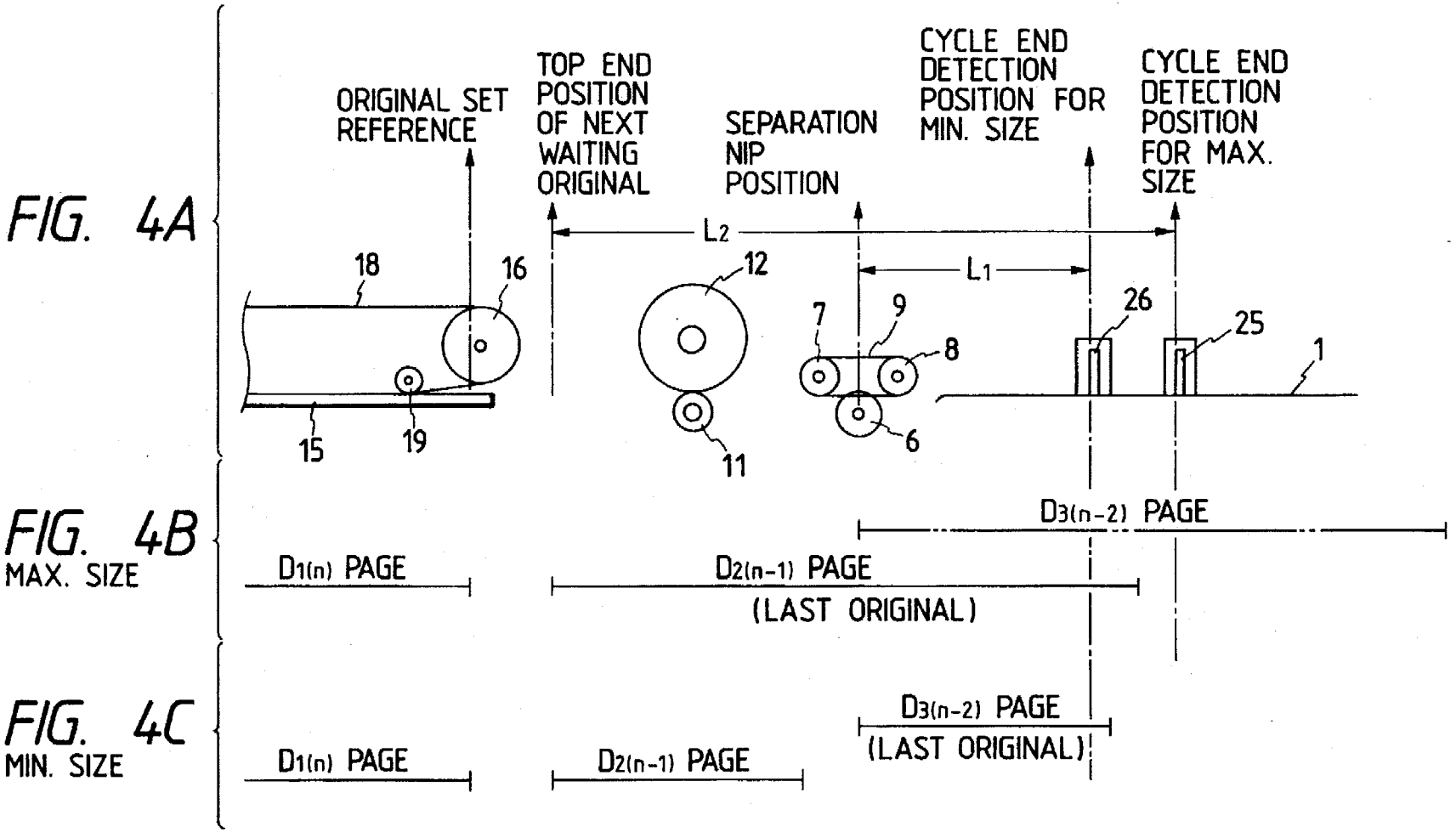
Figure 5:
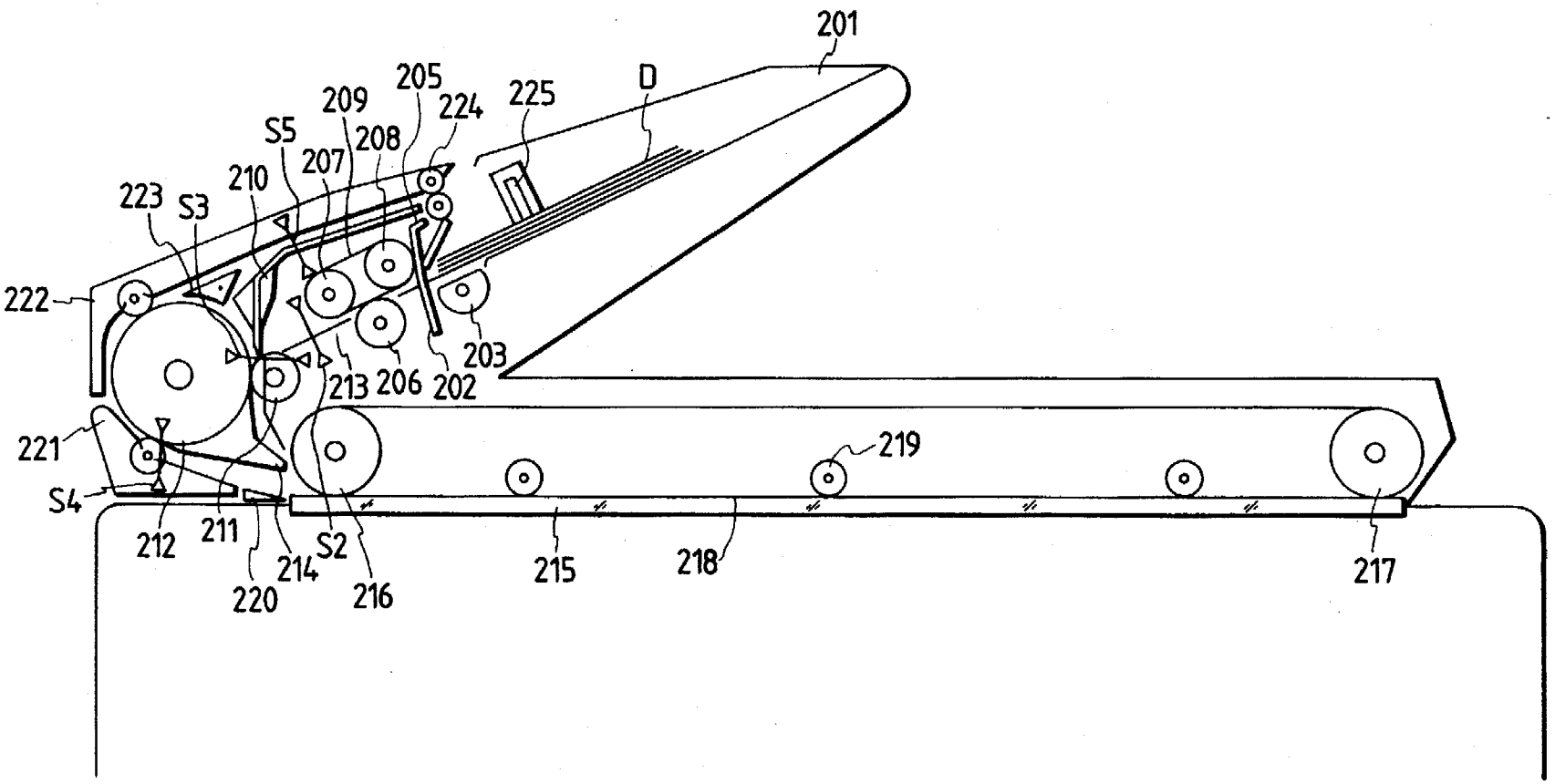
FIG. 5 PRIOR ART
FIG. 5 is an elevational sectional view of a conventional circulating original convey apparatus.
Figure 6A:
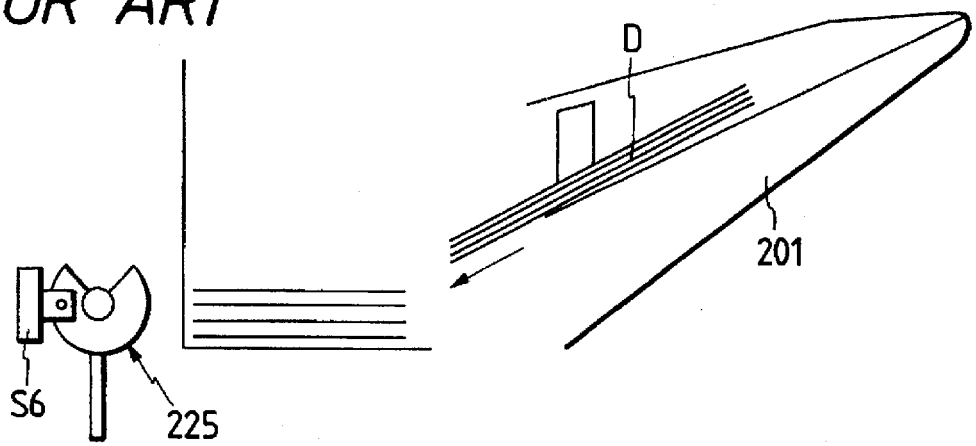
FIG. 6A PRIOR ART
FIGS. 6A to 6C are explanatory views for explaining an operation of a last original detection means of the conventional apparatus.
Figure 6B:
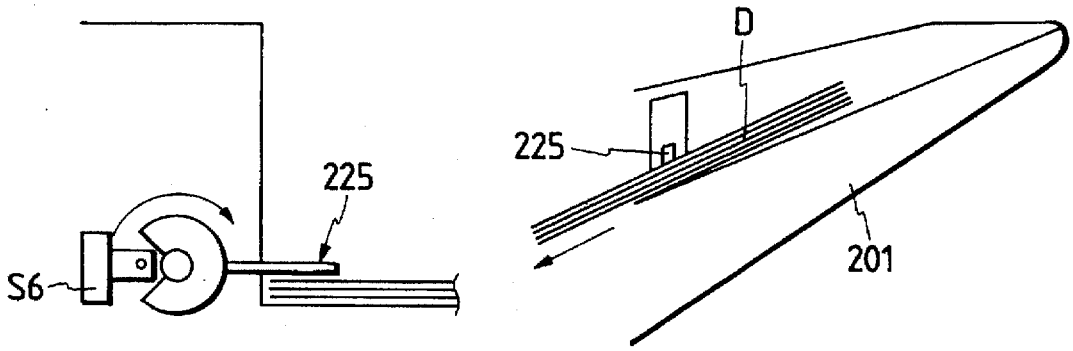
FIG. 6B PRIOR ART
Figure 6C:
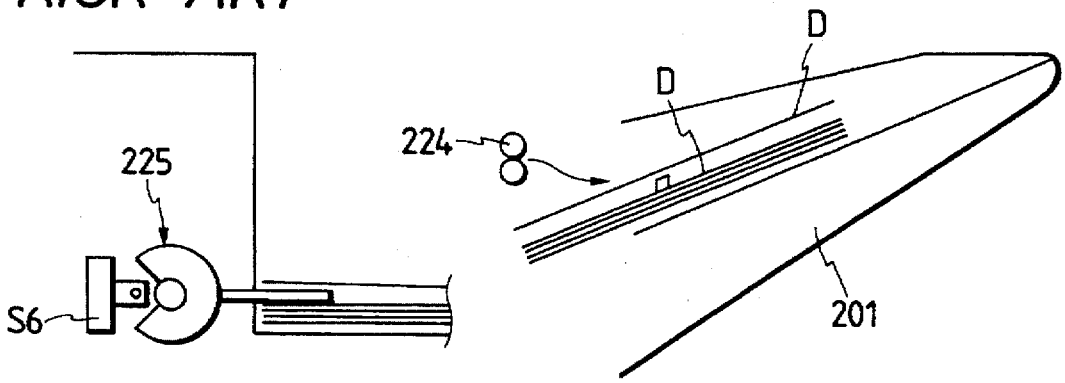
FIG. 6C PRIOR ART
Figure 7A:
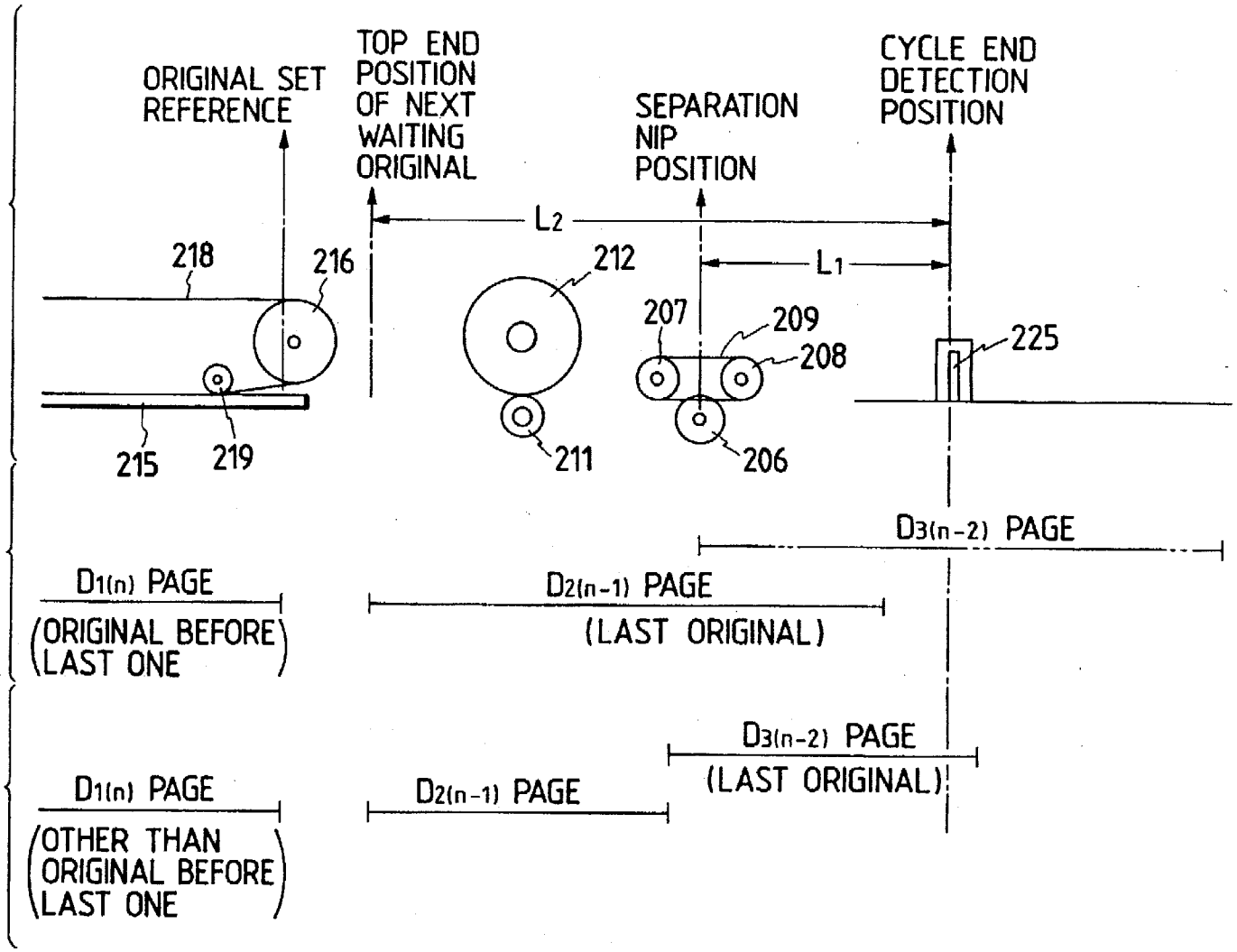
FIG. 7A PRIOR ART
FIG. 7A is a view showing an arrangement of the conventional last original-detection means.
Figure 8:
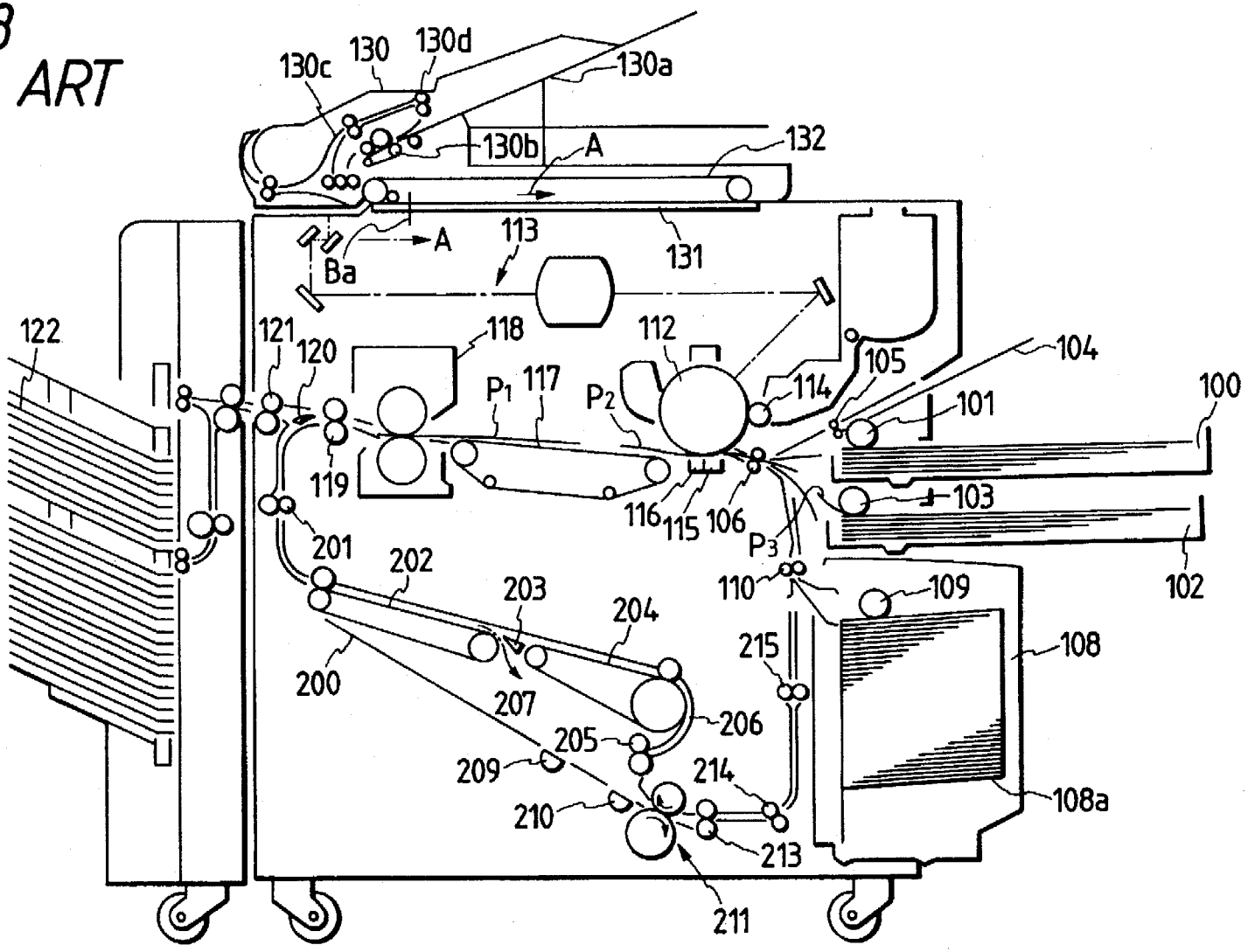
FIG. 8 PRIOR ART
FIG. 8 is an elevational sectional view of a conventional image forming apparatus having a circulating original convey apparatus.

Now, further explaining the position relation of the recycle levers 25, 26, as shown in FIG. 4, the recycle lever 25 is arranged so that a trailing end of the next original D2 ((n-1) page original) is positioned at a downstream side (toward the original supply portion) of this lever when the next original is waiting during the exposure of the first original D1 (n page original), and the recycle lever 26 is arranged so that a trailing end of the third original ((n-2) page original) is positioned at an upstream side (toward the original tray) of this lever at the above-mentioned timing.

These are because the cycle end signal is sent to the image forming apparatus before the next original D2 is rested on the platen 15 and because the original must escape from the recycle lever 26 at the waiting position (D2 position) of the next original D2 and because the original is prevented from escaping from the recycle lever 26 before the above timing to prevent the detection of the cycle end before the above timing. More particularly, when the original has a small size (FIG. 4C), as the last original D3 is conveyed to the D2 position, the recycle lever 26 is dropped, thereby detecting the cycle end. The use of the recycle lever 25 or the recycle lever 26 is based on the size detection data during the supplying of the lowermost original (first original) D1. Further, the use of the recycle lever may be based on the original size information manually inputted.

Explaining concretely, when an original on the platen is a first original, an original next to the first original is a second original, a transfer sheet (recording sheet) corresponding to the second original is a first sheet, and a transfer sheet next to the first sheet is a second sheet, it is necessary that it is judged whether the second original is the last original or not before the supply of the second sheet is started. If the second original is the last original (the first original is the original before last one), the second sheet is not supplied since there is no original corresponding to the second sheet. To the contrary, if the second original is not the last original (i.e. when a next original is detected by the recycle levers; the first original is not the original before last one), the second sheet is supplied for the next original.

Further, when the original size is greater than a predetermined size (for example, B4 size), since the original before last one cannot be detected by the sensors S6, S7, the sensor S6 acts as the last original detection means. From this, it is said as follows. An image forming apparatus having an original convey apparatus according to the present invention is characterized in that it comprises a last original detection means 25 for detecting a last original at any position, an original before last one detection means 25, 26 for detecting whether a second original is the last original or not before the supply of a second recording medium is started, when an original rested on an image reading portion is a first original, an original next to the first original is a second original, a recording medium corresponding to the second original is a first recording medium and a recording medium next to the first recording medium is a second recording medium, a first mode for controlling the supply of the first recording medium in response to a signal from the last original detection means, a second mode for controlling the supply of the second recording medium in response to a signal from the original before last one detection means, and a control means for controlling the switching between the first and second modes in response to an output from an original size detection means.

Figure 9:
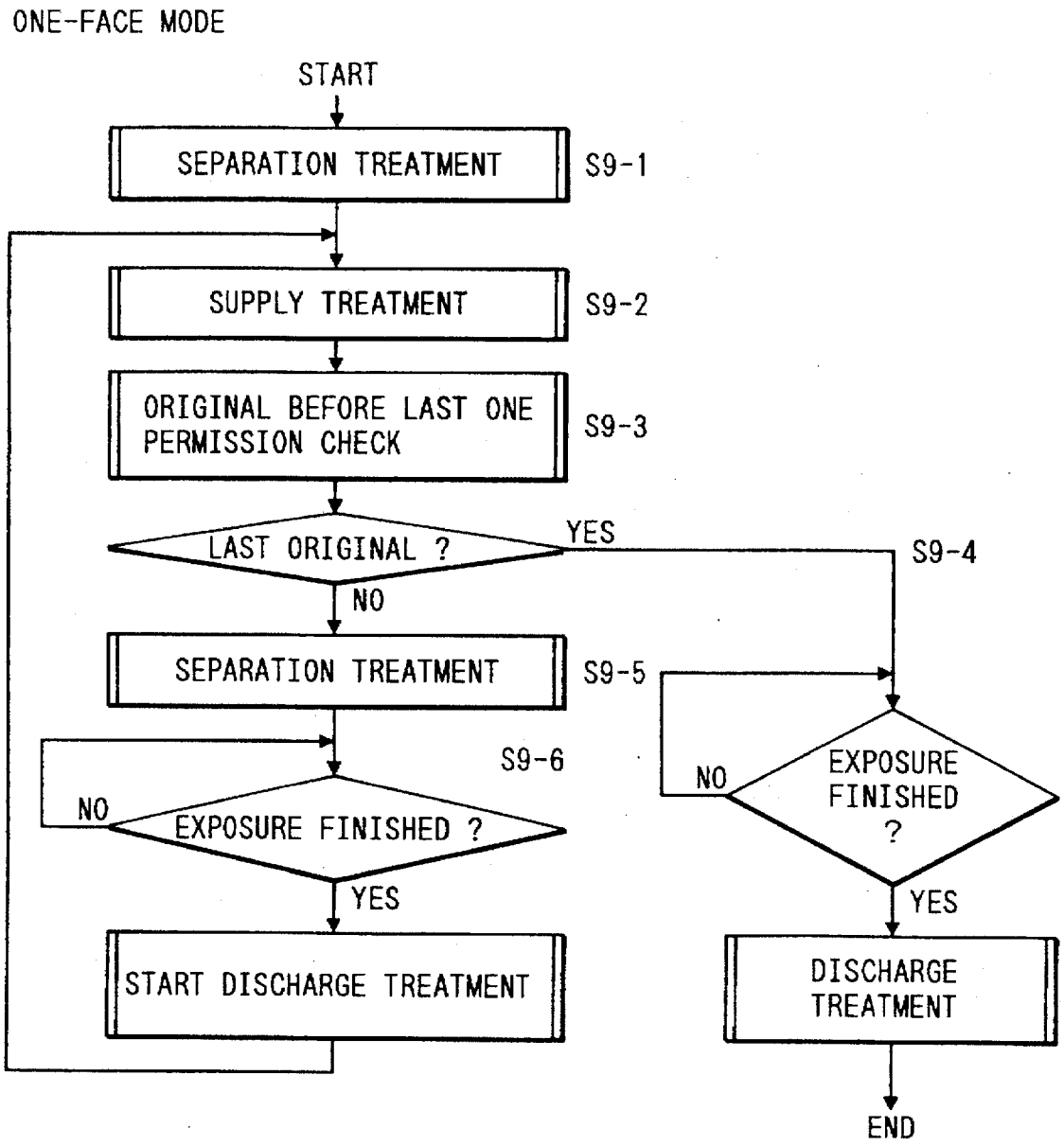
FIG. 9 is a flow chart regarding the original conveyance of the circulating original convey apparatus.

Next, an operation will be briefly explaining with reference to a one-face mode shown in FIG. 9.

First of all, in a condition that the empty sensor S1 is in an ON condition, when a start key (not shown) of the image forming apparatus is depressed, in a step 9-1, a separation treatment for separating the lowermost original D1 alone is effected, and in a step 9-2, the separated original D1 is supplied onto the platen 15. In a step 9-3, it is judged whether the "original before last one detection" (detecting whether there are two or more non-treated originals D excluding the original D1 on the platen 15) should be effected or not, in response to a size of the original D1 detected by the supply treatment. In a step 9-4, if the original D1 supplied on the platen 15 by the supply treatment is a last original Dn, the original Dn is discharged onto the original tray after the original is exposed by the image forming apparatus. To the contrary, if the original D1 is not the last original Dn, in a step 9-5, the separation treatment for a next original D2 is effected. In a step 9-6, after the exposure operation of the image forming apparatus is finished, the discharge treatment is started, and in the step 9-2, the supply treatment for the next original D2 is started, so that the supply and discharge of two originals D1, D2 are time share controlled.

Figure 10:
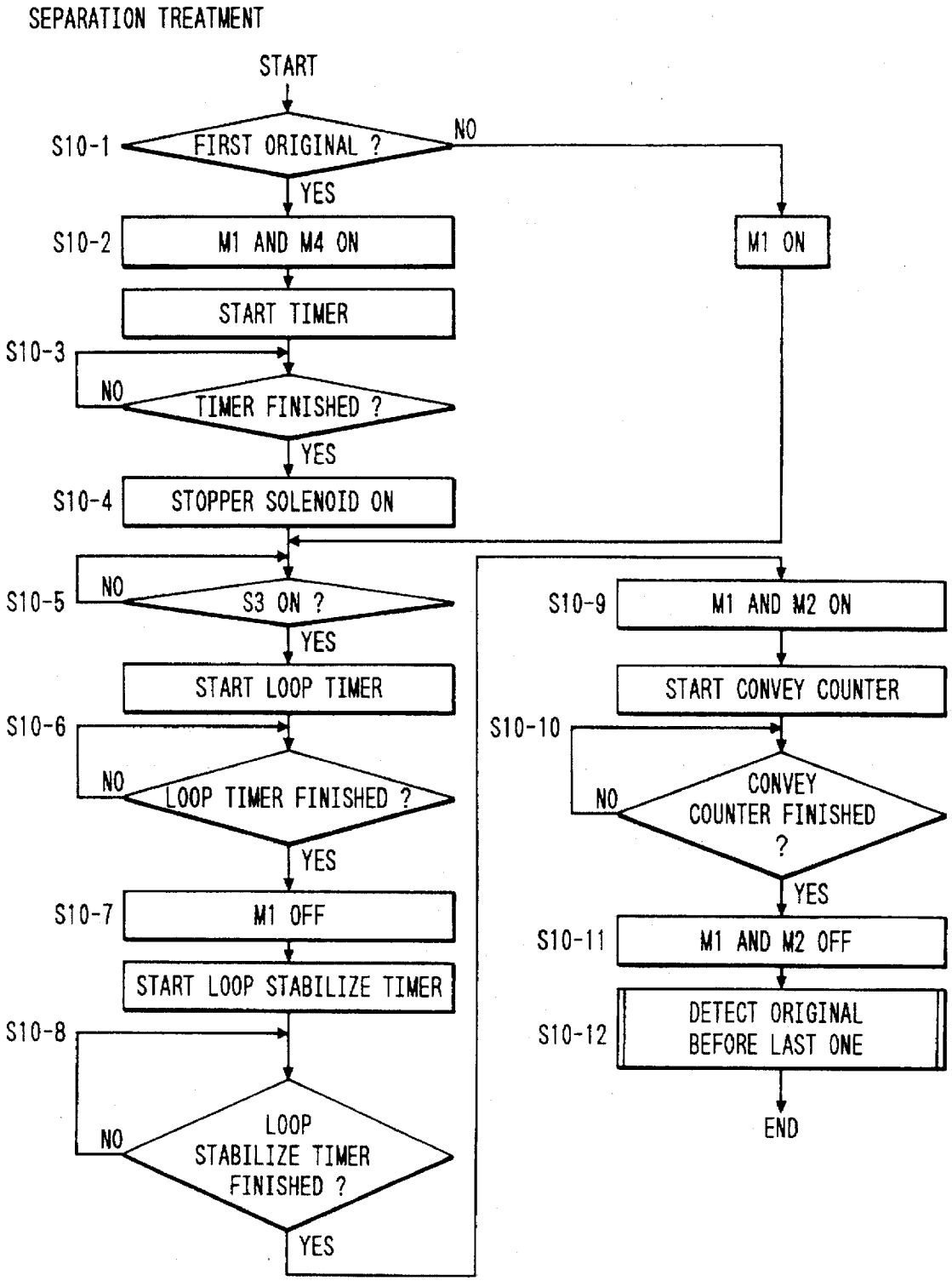
FIG. 10 is a flow chart showing a separation treatment.

Next, the separation treatment in FIG. 9 will be fully explained with reference to a flow chart shown in FIG. 10. In a step 10-1, it is judged whether the original D1 is first or not; if not first, the separation motor M1 is turned ON and the program goes to a step 10-5. If first, in a step 10-2, the recycle motor M4 is turned ON so that the recycle levers are held on the original stack on the original tray 1. Further, the separation motor M1 is turned ON, and in a step 10-3, this motor is driven for a predetermined time, thereby treating the original stack. In a step 10-4, a stopper solenoid is turned ON so that the convey of the original D1 to the separation portion is permitted. In the step 10-5, the regist sensor S3 detects the leading end of the original. After the detection, in a step 10-6, the leading end of the original is abutted against the roller nip between the regist roller 11 and the reverse rotation roller 12 to form a loop in the original, thereby correcting the skew-feed of the original D. In a step 10-7, the separation motor M1 is turned OFF, and in a step 10-8, a time for stabilizing the loop is elapsed. In a step 10-9, the separation motor M1 and the convey motor M2 are turned ON, and in a step 10-10, the original is conveyed by a predetermined amount. In a step 10-11, the separation motor M1 and the convey motor M2 are turned OFF, and in a step 10-12, the original before last one detection is started. In this way, the separation treatment is ended.

Figure 11:
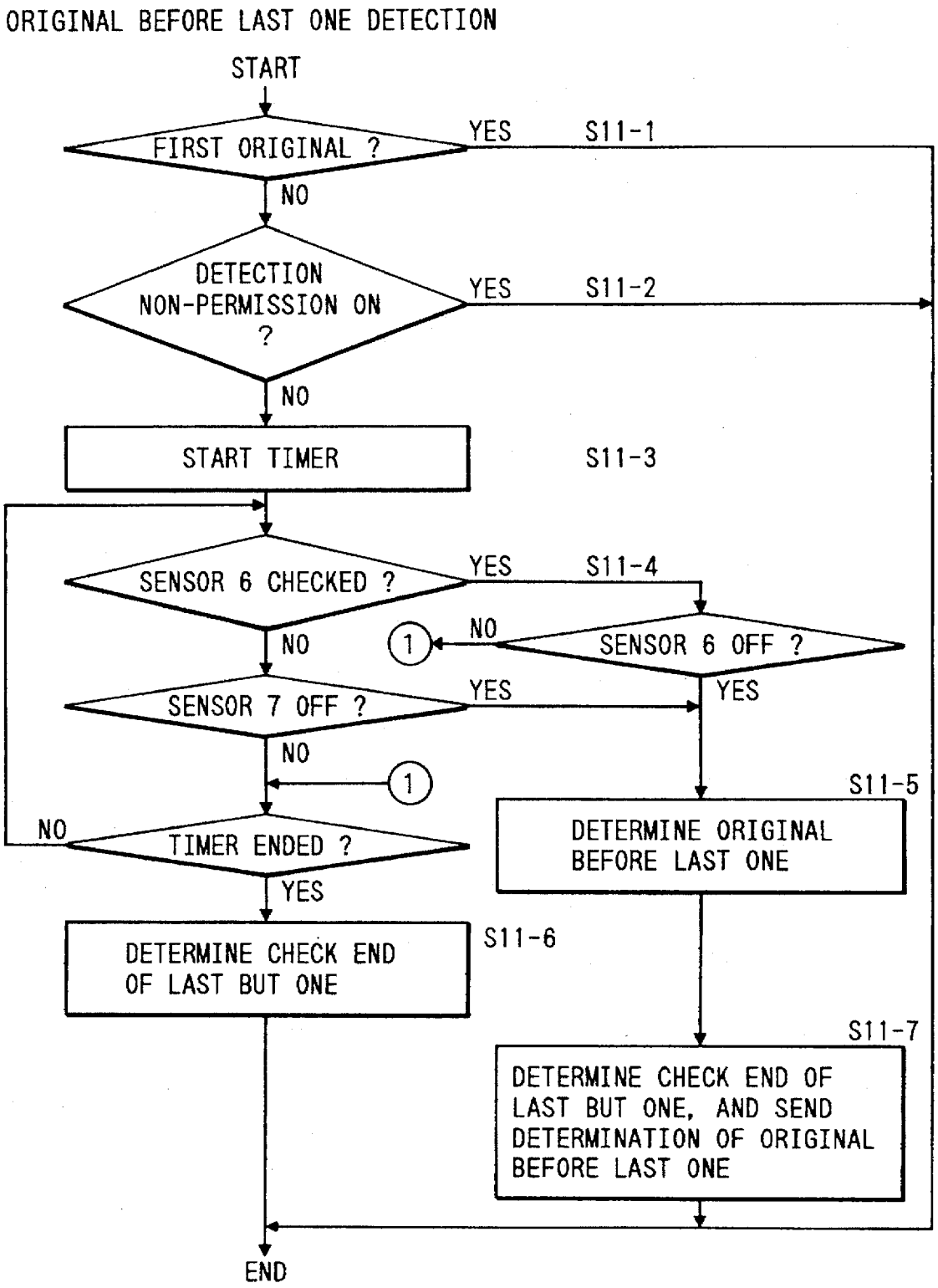
FIG. 11 is a flow chart showing an original before last one detection.

Next, the original before last one detection in the separation treatment will be explained with reference to a flow chart shown in FIG. 11.

In a step 11-1, in order to judge whether the original before last one detection is effected or not on the basis of the size of the first original D1, when the first original D1 is separated, the original before last one detection is not effected, and this treatment is ended. In a step 11-2, when the detection non-permission is set, the treatment is ended. In a step 11-3, a predetermined time for correctly effecting the original before last one detection is started. In a step 11-4, the recycle lever 25 or the recycle lever 26 for effecting the original before last one detection is selected. The sensor S6 or the sensor S7 for sensing the movement of the selected recycle lever is checked, and, in case of the sensor S6 or the sensor S7, when the recycle lever is dropped from the last original Dn of the original stack within a predetermined time, an original D before last one is determined in a step 11-5. In a step 11-6, the end of the check of last but one for informing of the image forming apparatus the fact that the check of last but one is finished is determined.

Further, if the recycle lever does not drop from the last original Dn of the original stack within the predetermined time, in case of the sensor S6 or the sensor S7, in the 11-6, the end of the check of last but one is determined, and a signal therefor is sent to the image forming apparatus.

When only the determination of the check end of last but one is set, the image forming apparatus previously supplies the transfer sheet to which the image on the original D on the original tray is to be transferred, and, when the determination of the check end of last but one and the determination of the original before last one are set, the image forming apparatus controls the supply of the transfer sheet not to supply the transfer sheet.

Figure 12:
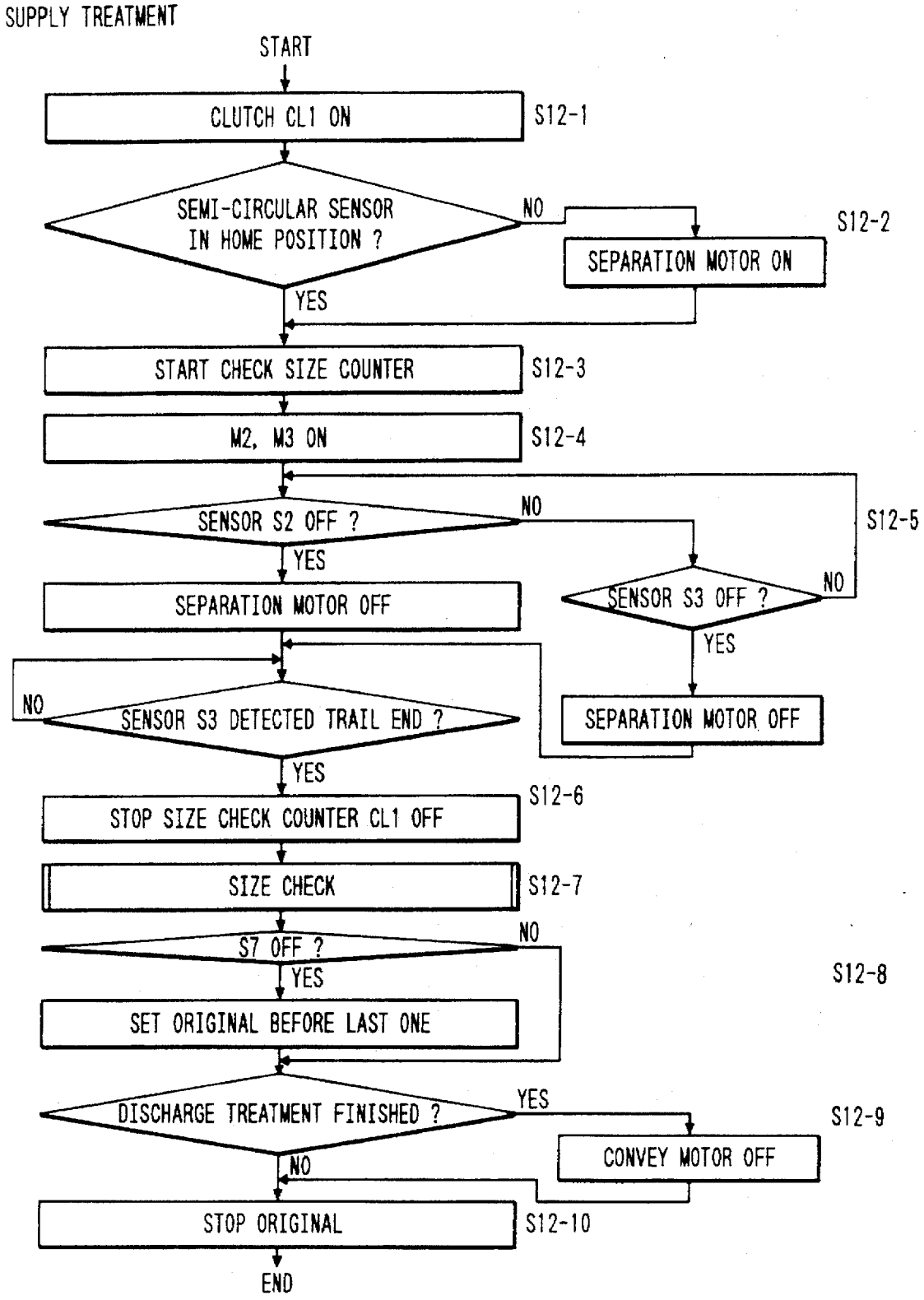
FIG. 12 is a flow chart showing a supply treatment.

Next, the supply treatment of FIG. 9 will be described with reference to a flow chart shown in FIG. 12.

Figure 13:
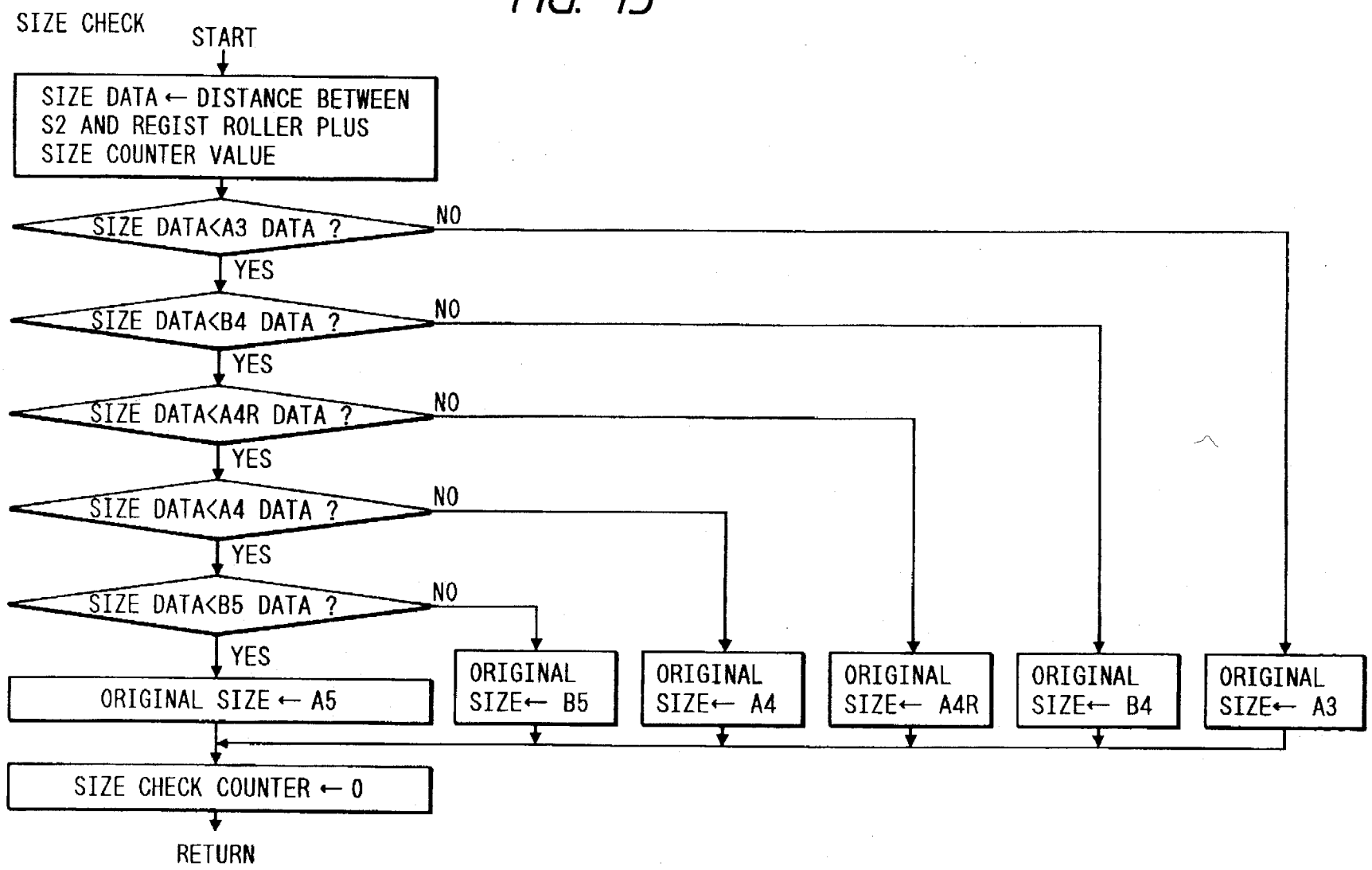
FIG. 13 is a flow chart showing a size check.

In a step 12-1, the clutch CL1 is turned ON in order to stabilize the drive of the reverse rotation roller 12 and the convey belt 18. In a step 12-2, it is judged whether the semi-circular roller 3 is returned to a home position on the way of the separation treatment; if the roller is not in the home position, the separation motor M1 is turned ON. In a step 12-3, a size check counter for detecting the size of the original D being conveyed is started. In a step 12-4, the convey motor M2 and the belt motor M3 are turned ON. In a step 12-5, when either the separation sensor S2 or the regist sensor S3 is turned OFF, the separation motor M1 is turned OFF. Now, the separation motor M1 turned ON in the step 12-2 is turned OFF by the timing at the step 12-5 or by an output from a home position sensor S8 which will be described later. In a step 12-6, when the trailing end of the original D is detected by the regist sensor S3, the size check counter is stopped and the clutch CL1 is turned OFF. In a step 12-7, the size of the original is detected by a sub-routine shown in FIG. 13, and in a step 12-8, the last original detection is effected by ON/OFF (last sheet) of the sensor S7. In a step 12-9, when the discharge treatment of the preceding original D has been finished, the convey motor M2 is turned OFF, and in a step 12-10, the regist treatment is effected and the supply treatment is ended.

Figure 14:
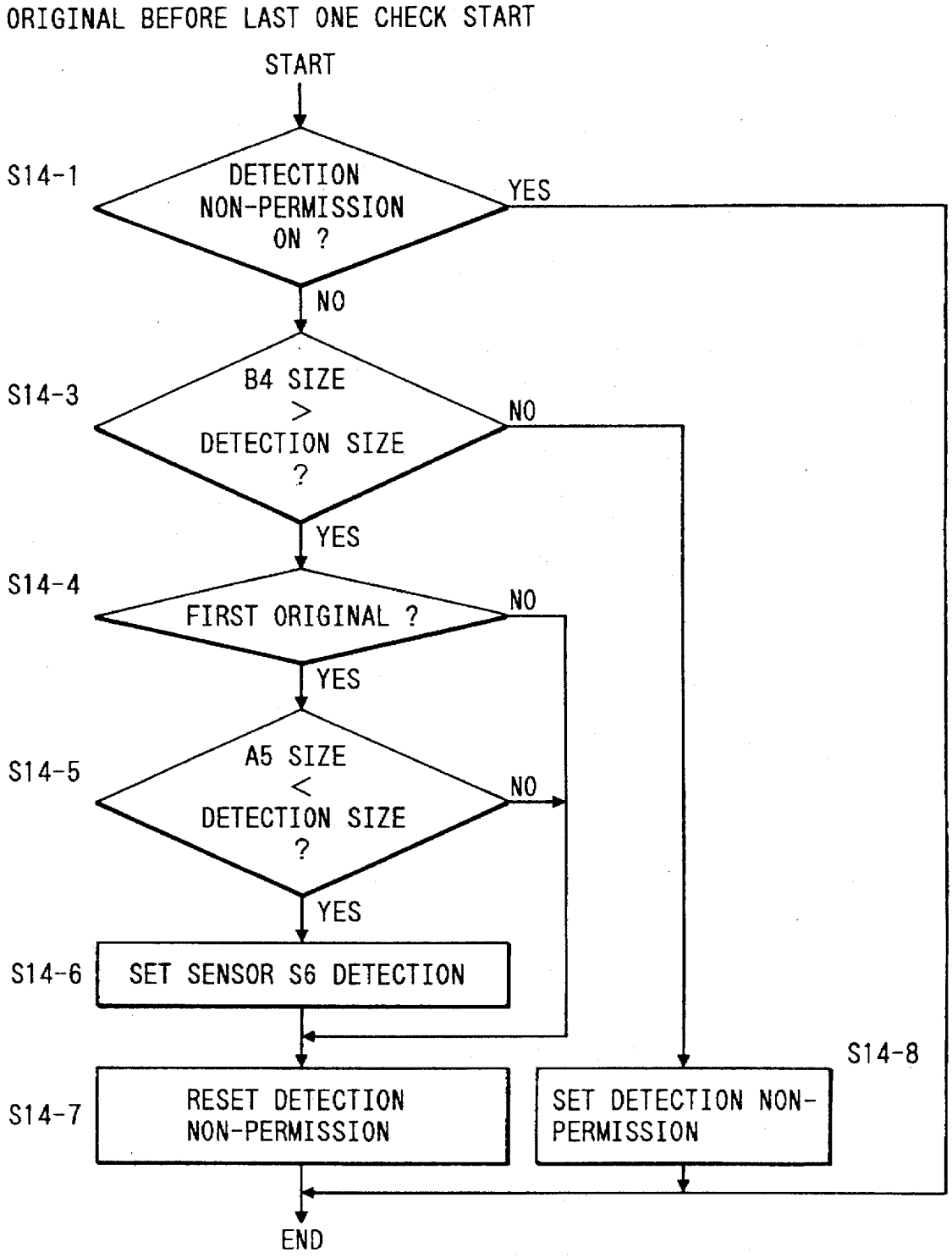
FIG. 14 is a flow chart showing a mode switching.
Figure 14:
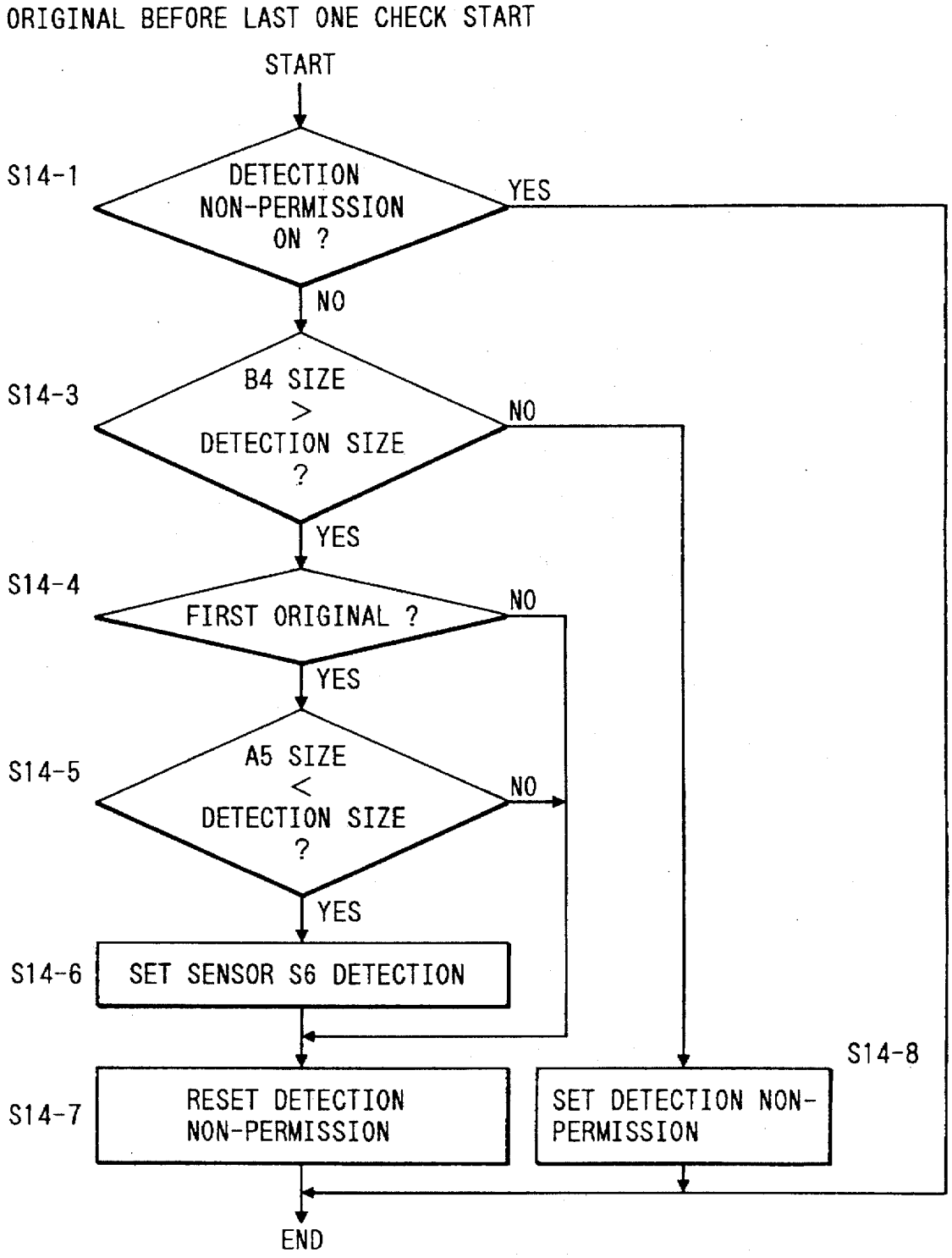

Next, the original before last one permission check in the step 9-3 of FIG. 9 will be explained with reference to a flaw chart shown in FIG. 14. In a step 14-1, it is judged whether the detection non-permission has been set or not; if it was set, the treatment is ended. In a step 14-3, it is judged whether the supplied original D has a size permitting the original before last one detection or not by using the original size detected by the size check; if the size of the original does not permit the original before last one detection, in a step 14-8, the detection non-permission is set, and the treatment is ended. In a step 14-4, it is judged whether the supplied original D is first or not; if not first, in a step 14-7, the detection non-permission is reset. If the original is not first, since the condition has already been determined, the condition is not required to be changed. To the contrary, if the original is first, when the supplied original has a size greater than a predetermined value, the detection of the recycle sensor S6 is set in order to effect the original before last one detection by the recycle sensor S6, and in the step 14-7, the detection non-permission is reset, and the treatment is ended. If the original size has the predetermined value, the detection of the sensor S7 is set. In the illustrated embodiment, the detection of the sensor S7 is the normal mode.

Next, the discharge treatment of FIG. 9 will be explained with reference to a flow chart shown in FIG. 15. In a step 15-1, the belt motor M3 is rotated reversely by a predetermined amount, and in a step 15-2, the speed of the belt motor M2 is reduced, and, immediately after the reverse rotation sensor S4 is turned ON, the original is conveyed by a predetermined distance in a step 15-3, and the belt motor M3 is turned OFF. In a step 15-4, the convey motor M2 is turned ON to convey the original by a predetermined distance during which the speed of the belt motor M3 becomes slow adequately. In a step 15-5, an electromagnetic brake is turned ON, thereby stopping the belt motor M3 within the time period in which the convey motor is driven by the predetermined amount. In a step 15-6, the electromagnetic brake is physically turned OFF within the time period in which the convey motor M2 is driven by the predetermined amount. In a step 15-7, ON of the discharge sensor S5 is waiting, and in a step 15-8, OFF of the reverse rotation sensor S4 is waiting. In a step 15-9, OFF of the discharge sensor S5 is waiting, and in a step 15-10, the control of the discharge speed of the conventional convey motor M2 is started.

Figure 16:
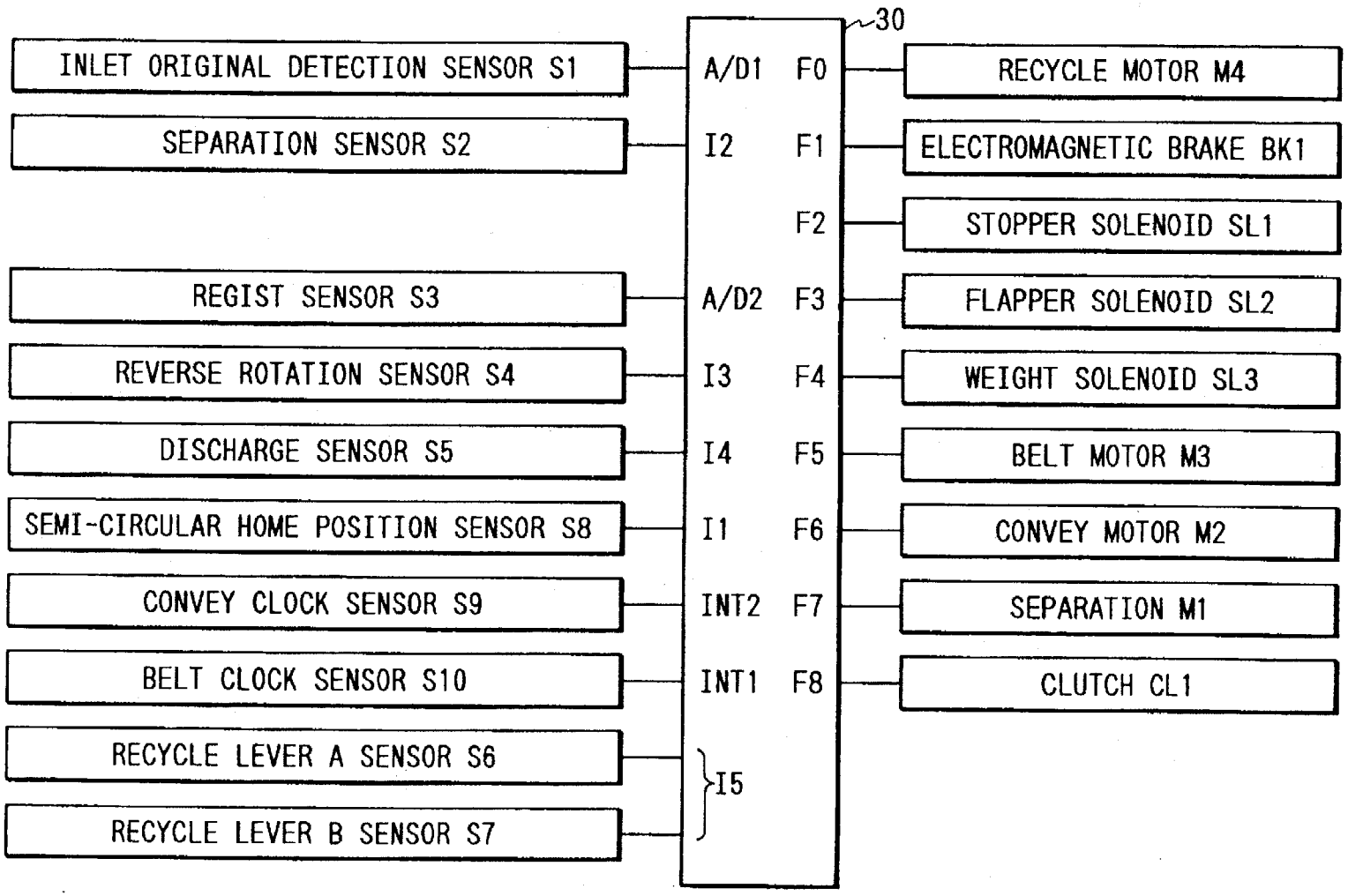
FIG. 16 is a block diagram of a control means of the circulating original convey apparatus.

FIG. 16 is a block diagram showing a control system according to the illustrated embodiment. This control system mainly comprises a conventional one-chip microcomputer (referred to as "CPU" hereinafter) 30 including ROM, RAM and the like. A semi-circular home position sensor S8 for detecting the home position where the semi-circular roller 3 is not protruded in the convey path by a clock disc attached to a shaft of the separation drive motor M1 is connected to an input port I1 of the CPU 30. The separation sensor S2, reverse rotation sensor S4, discharge sensor S5 and recycle sensors S6, S7 are connected to input ports I2–I5 of the CPU, respectively. The empty sensor (inlet original detection sensor) S1 and the regist sensor S3 are connected to A/D channels A/D1, A/D2, respectively. Further, a signal from a belt clock sensor S10 for detecting the rotation of the motor by a clock disc attached to a shaft of the belt motor, and a signal from a convey clock sensor S9 for detecting the rotation of the motor by a clock disc attached to a shaft of the convey motor are inputted to interruption terminals INT1, INT2 of the CPU, respectively. The later signal is used as a reference clock for the shifting amount of the original, and the clocks are counted by a counter in the CPU. The recycle motor M4 for driving the recycle levers 25, 26, the electromagnetic brake BK1 attached to a shaft of the belt motor M3 and adapted to stop and inhibit the drive of the belt motor M3, the stopper solenoid SL1 for opening and closing the convey path for the original D, a flapper solenoid SL2 for driving the drive of the flapper 23 for controlling the reverse rotation operation and the discharge operation of the original D, a weight solenoid SL3 for driving the weight 4, the belt motor M3, the convey motor M2, the separation motor M1, and the clutch CL1 are connected to output ports F0–F8 of the CPU, respectively.

Another embodiment will be explained.

Figure 17:
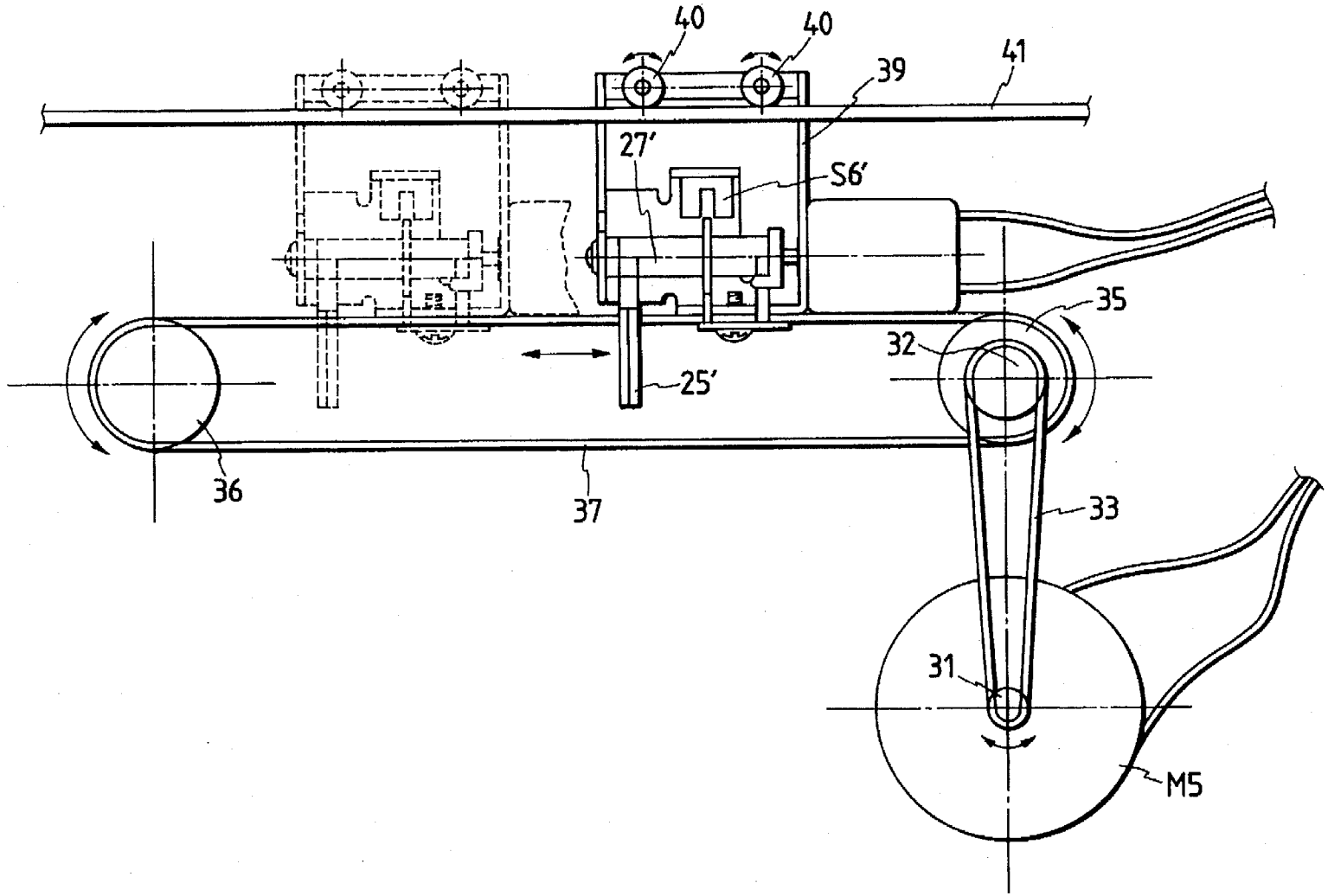
FIG. 17 is a view for explaining an operation of a self-moving last original detection means.

In the aforementioned embodiment, while two recycle levers 25, 26 were used to provide two original before last one detection positions, in this another embodiment, by automatically shifting a single recycle lever 25' in accordance with the size of the original, a plurality of original before last one detection positions can be provided. More particularly, as shown in FIG. 17, a belt 33 is mounted around and between an output shaft 31 of a shifting pulse motor M5 and a pulley 32, and a moving belt 37 is mounted around and between a pulley 35 coaxial with the pulley 32 and a corresponding pulley 36. An unit 39 including a recycle lever 25', a recycle arm 27' and a recycle sensor S6' is secured to the moving belt 37. The unit 39 has rotatable rollers 40 which can roll on guide rails 41 extending to a shifting direction of the recycle lever 25'.

Figure 18:
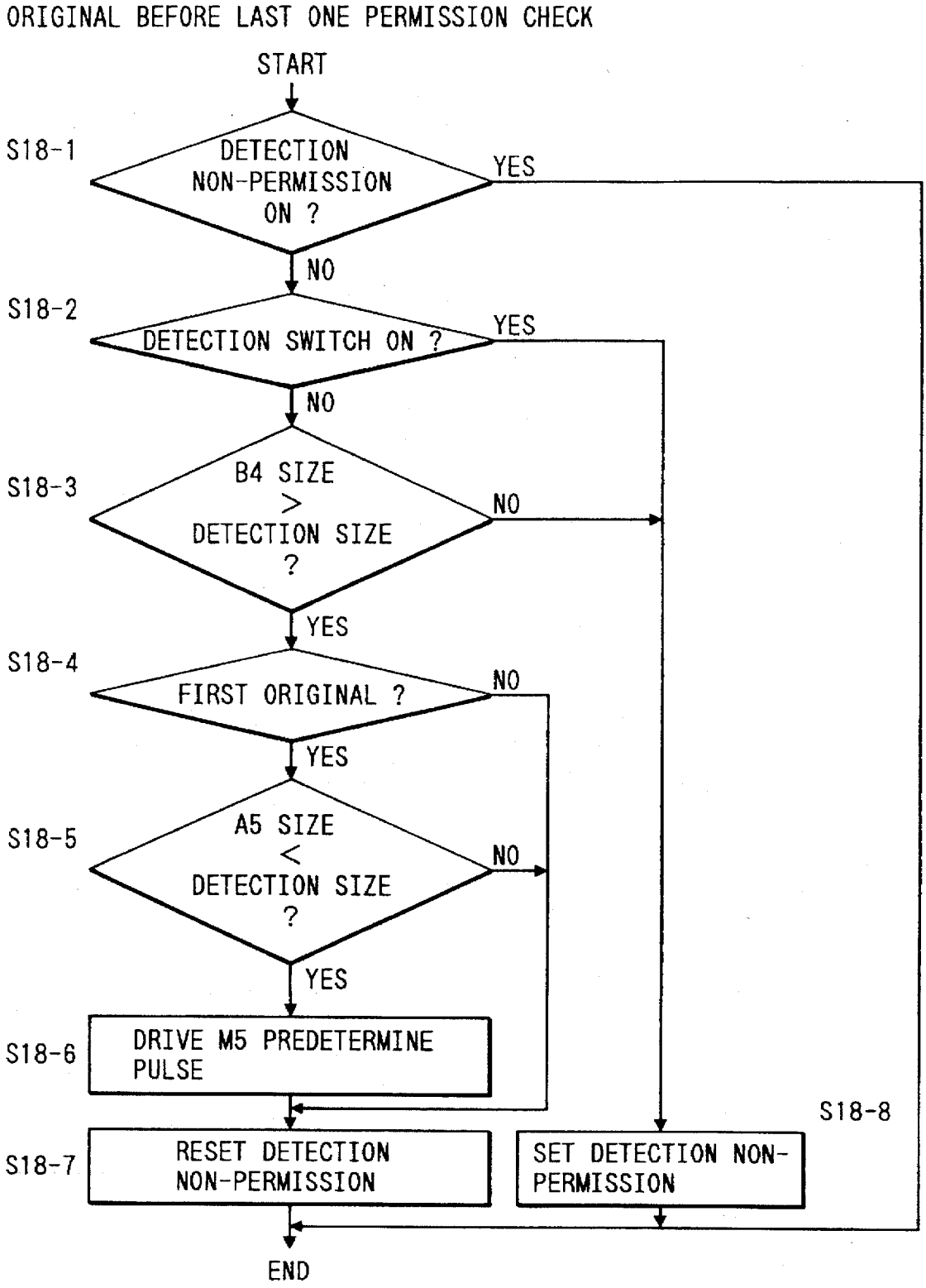
FIG. 18 is a flow chart showing a mode switching of the self-moving last original detection means.
Figure 19:
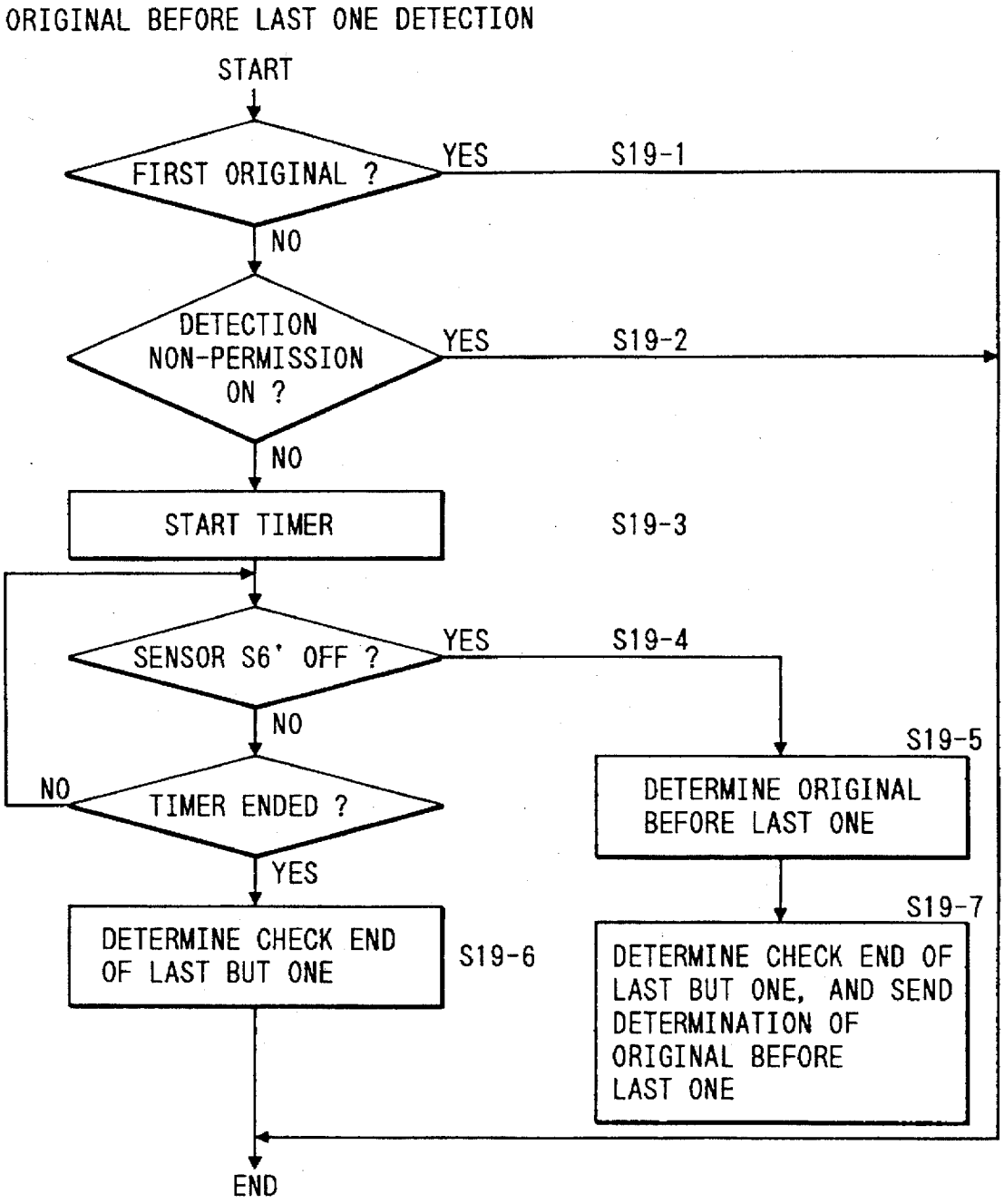
FIG. 19 is a flow chart showing an original before last one in the self-moving type last original detection means.
Figure 20:
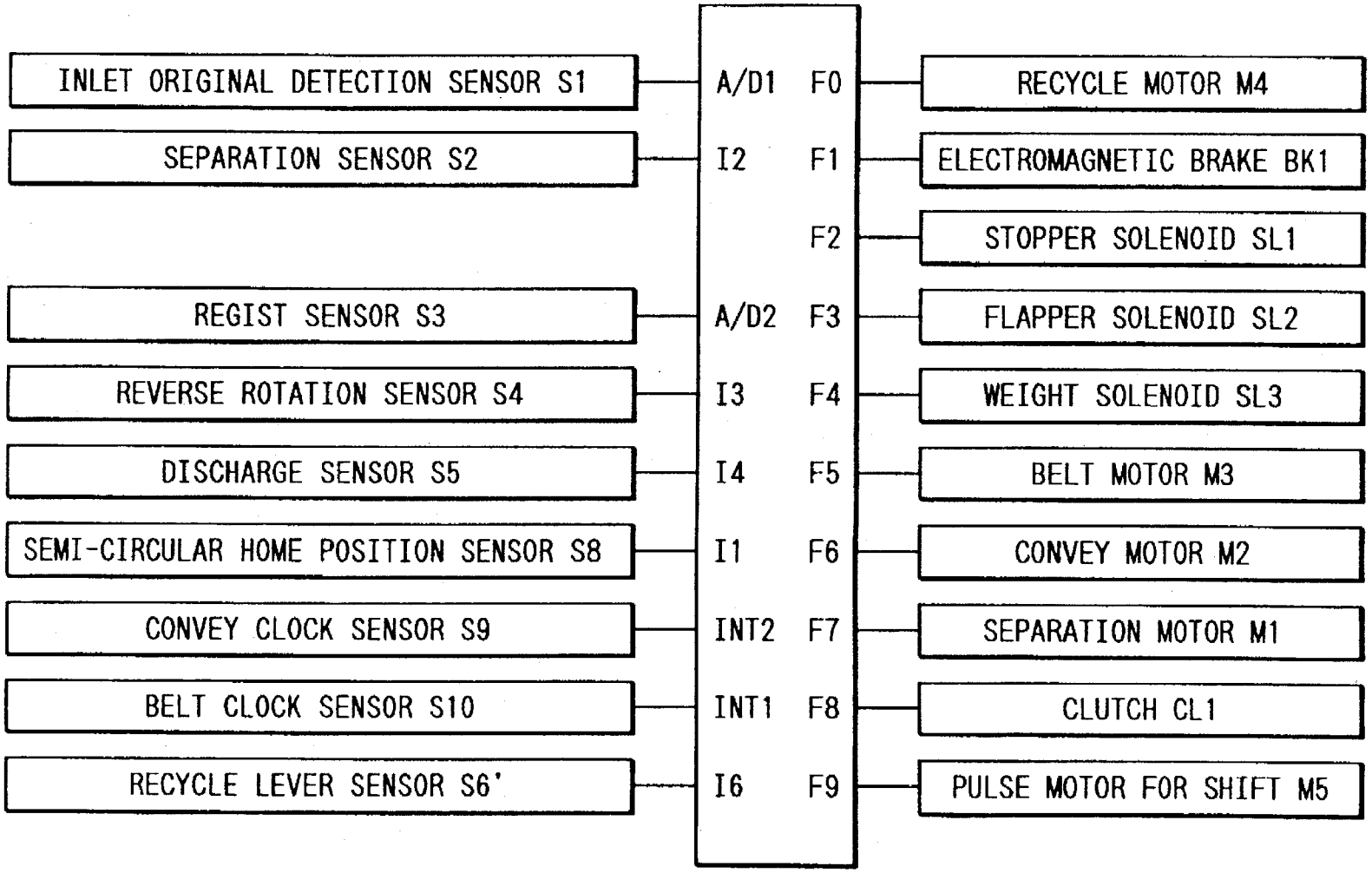
FIG. 20 is a block diagram of a control means of a circulating original convey apparatus having a self-moving type last original detection means.

In operation, in the original last but one permission check in the aforementioned embodiment, in a step 18-5 of a flow chart shown in FIG. 18, when the detected original size is greater than A5 size, in a step 18-6, the motor M5 is driven by a predetermined number of pulses, thereby shifting the recycle lever 25' to a proper position (where, when the original is in the next original waiting position, the trailing end of the original can be escaped from the recycle lever 25', and, when the original is in the separation nip portion, the trailing end of the original cannot be escaped from the recycle lever). Further, in the original before last one detection in the aforementioned embodiment, in a step 19-4 of a flow chart shown in FIG. 19, it is judged whether the determined of the original before last one is set or not by the fact whether the sensor S6' is turned OFF or not within the predetermined time period. Further, after a series of image forming operations, the recycle lever 25' is returned to its original position. The control system is shown in FIG. 20. With this arrangement, the same advantage as that of the aforementioned embodiment can be achieved.

Figure 21:
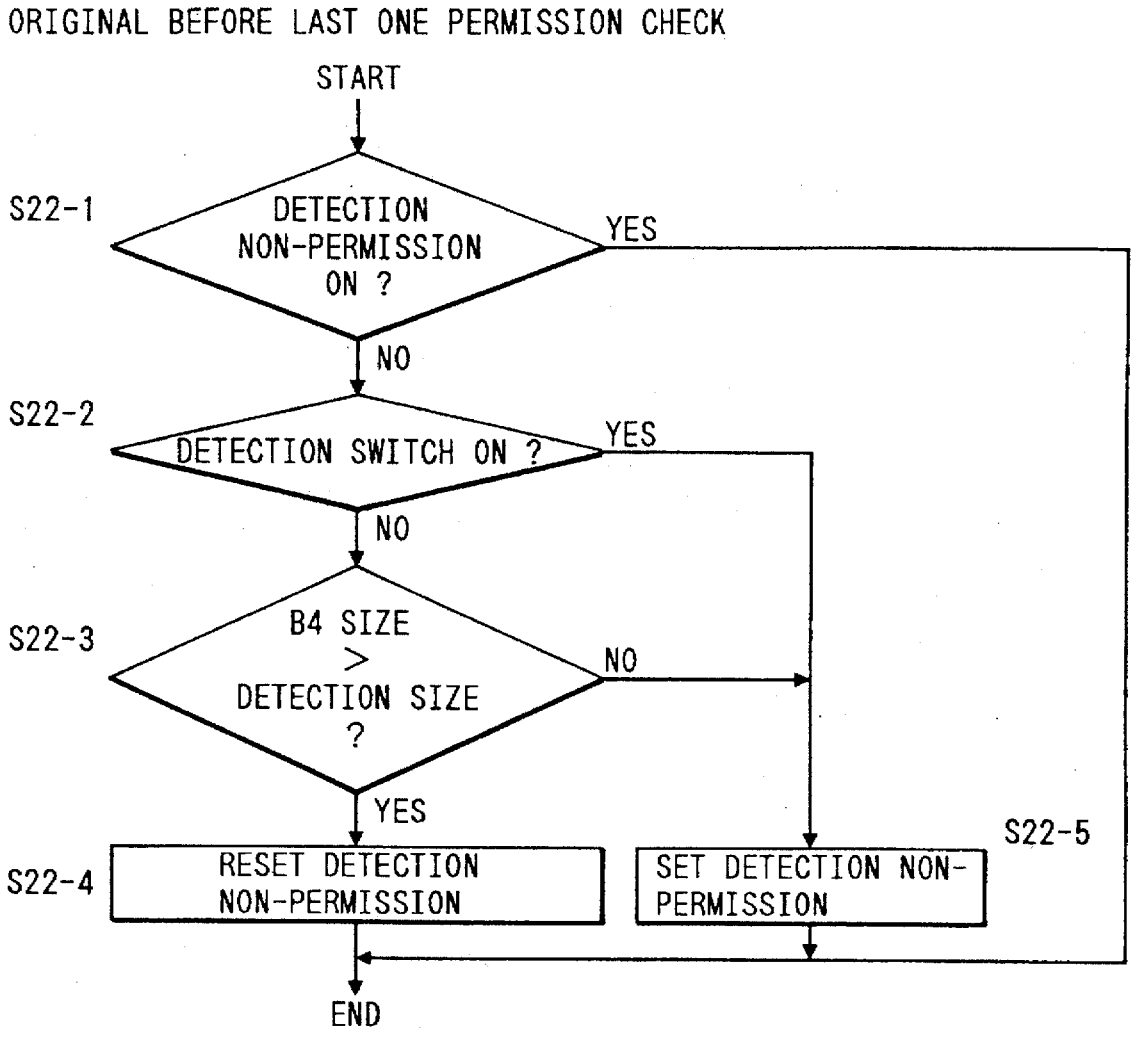
FIG. 21 is a flow chart showing a mode switching of a manual-moving type last original detection means.
Figure 22:
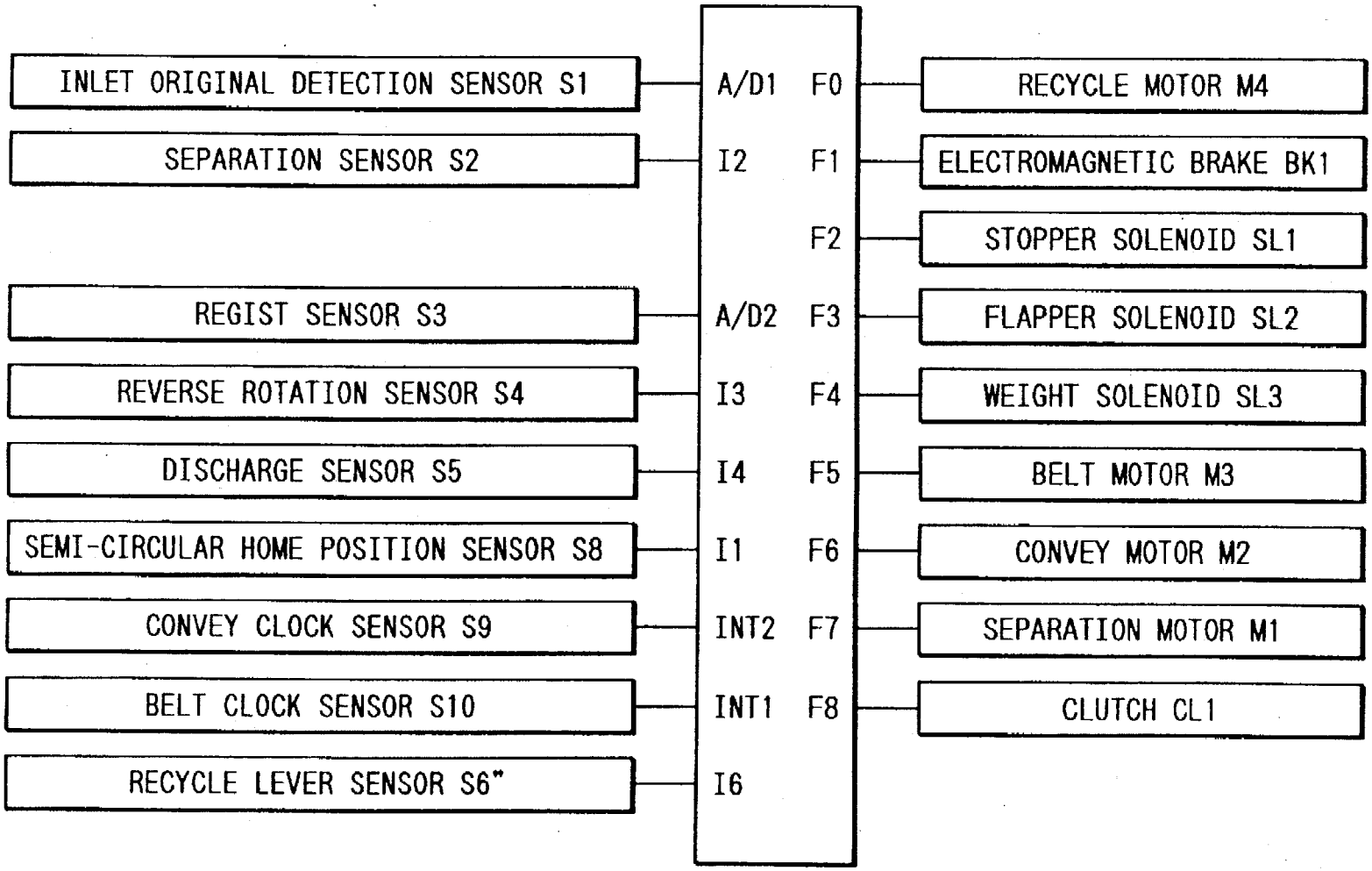
FIG. 22 is a block diagram of a control means of a circulating original convey apparatus having a manual-moving type last original detection means.

Further, when originals that the detection last but one position is constant are mainly used, the detection position of the original before last one is manually set to a given position by a recycle lever 25", a recycle sensor S6" and a recycle arm 27". In this case, the control shown by a flow chart of FIG. 21 and the control arrangement shown in FIG. 22 are used. Thus, it is possible to save the provision of the shifting motor, thereby reducing the cost and to reduce the time for automatically shifting the lever, and the same advantage as that of the aforementioned embodiment can be achieved.

A further embodiment will be explained.

Figure 23:
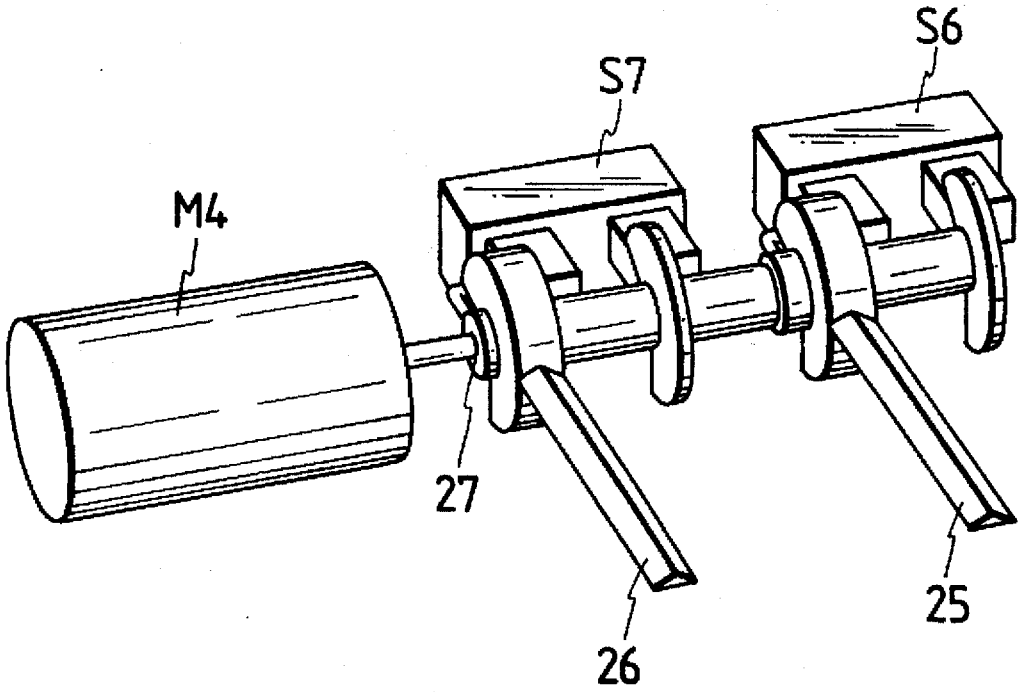
FIG. 23 is a perspective view showing an example of a drive source for driving a plurality of last original detection means.

In the above-mentioned embodiments, while the recycle levers 25, 26 were attached to both shafts of the recycle motor M4 to detect the last original, as shown in FIG. 23, a recycle arm 27 may be mounted on one end of the motor M4, and the recycle lever 26 may be driven by the recycle arm 27 and at the same time the recycle lever 25 may be driven by the recycle lever 26. Also in this case, the same advantage can be achieved. Further, in this case, it is apparent that, when the driven recycle lever 25 is disposed remote from the original supply portion (upstream side of the conveying direction), this lever can be driven without being influenced upon the drive mechanism.

A still further embodiment will be explained.

As described below, the pre-protrusion of the original may be not effected for the large size original, but the pre-protrusion of the original may be effected for the small size original. To this end, there is provided an image forming apparatus having a circulating original convey apparatus comprising an original tray 1 for resting originals thereon, an original supply portion 6 to 9 for conveying the rested original to an image reading portion and a discharge portion 24 for conveying and discharging the original from the image reading portion to the original tray, and adapted to read an image on the original and form an image on a recording medium, which image forming apparatus comprises a last original detection means 25 for detecting a last original at any position, an original before last one detection means 25, 26 for detecting whether a second is the last original or not before the supply of a second recording medium is started, when an original rested on the image reading portion is a first original, an original next to the first original is a second original, a recording medium corresponding to the second original is a first recording medium and a recording medium next to the first recording medium is a second recording medium, a first mode for controlling the supply of the first recording medium in response to a signal from the last original detection means, a second mode for controlling the supply of the second recording medium in response to a signal from the original before last one detection means, and a control means for controlling the switching between the first and second modes in response to an output from an original size detection means.

In the above arrangement, two or more last original detection means may be provided, and one of the last original detection means may be used as the original before last one detection means in response to the output of the original size detection means. Further, the single last original detection means may be shifted in response to the size of the original. Further, the last original detection means may be automatically shifted in response to the output of the original size detection means. The control means controls to select the first mode in the first original conveying operation at the beginning of the image forming operation.

What is claimed is:

1. An original convey apparatus, comprising:

an original tray for resting originals thereon;

original supply means for supplying the originals from said original tray toward a reading position disposed downstream in a conveyance direction from said original tray;

a plurality of original detection means for detecting whether any of the originals have not yet been supplied from said original tray to the reading position, said plurality of original detection means being disposed at different positions corresponding to varying original sizes; and original size information means for detecting original size information, wherein selection of one of said original detection means is dependent on the detected original size information, and wherein a first of said plurality of original detection means is for detecting large-sized originals, and a second of said plurality of original detection means is for detecting small-sized originals, said second original detection means being disposed downstream in the conveyance direction from said first original detection means.

2. An original convey apparatus according to claim 1, further comprising a return path for returning originals discharged from the reading position to said original tray, and wherein at least one of said plurality of original detection means comprises a recycle lever for discriminating returned originals and non-supplied originals.

3. An original convey apparatus according to claim 1, wherein said original size information means is a size detection sensor disposed in a convey path.

4. An image forming apparatus having an original convey apparatus according to claim 1.

5. An original convey apparatus according to claim 1, wherein one of said plurality of original detection means selected is set in a detachable condition.

6. An original convey apparatus according to claim 1, wherein said first and second original detection means are setable in a first and second position respectively, said first and second positions corresponding to dimensions of small-sized and large-sized originals respectively, where a trailing end of a last small-sized or large-sized original to be supplied by said supply means from said original tray is located adjacent and downstream in the conveyance direction of said first or second detection means respectively.

7. A sheet convey apparatus according to claim 1, wherein the distance between the first and second detection means is adjustable so that, when the large-size original is supplied by said supply means the trail end of the large-size original is located between said first detection means and said second detection means, and before the small-size original is supplied by said supply means the trail end of said small-size original is located between said first detection means and said second detection means.

8. An original convey apparatus according to claim 1, wherein:

said original supply means includes convey means for conveying a current original to a hold position, located in the conveyance direction between said original tray and the reading position, where said current original is held when a preceding original is in the reading position; and said plurality of original detection means detects whether there are any succeeding originals on said original tray to be conveyed.

9. An image forming apparatus having an original convey apparatus according to claim 1, further comprising:

image forming means for reading an image from a current original onto a current recording sheet when the current original is located at the reading position;

sheet supply means for supplying a recording sheet to said image forming means; and control means for controlling said sheet supply means so that said sheet supply means supplies the recording sheet to said image forming means, whenever said original detection means detects that any of the originals have not yet been supplied from said original tray to the reading position.

10. An original conveying apparatus according to claim 1, wherein said plurality of original detection means are located on said original tray.

11. An original convey apparatus, comprising:

an original tray for resting originals thereon;

original supply means for supplying the originals from said original tray toward a reading position disposed downstream in a conveyance direction from said original tray;

a plurality of original detection means for detecting whether any of the originals have not yet been supplied from said original tray to the reading position, said plurality of original detection means being disposed at different positions corresponding to varying original sizes; and original size information means, wherein selection of one of said original detection means is dependent on the original size information, and wherein said plurality of original detection means includes a plurality of lever means corresponding to varying original sizes for being rested on an original stack on said original tray and capable of being freely dropped when all of the originals have been supplied from said original tray, and a motor for rotating said plurality of lever means onto the original stack.

12. An original conveying apparatus according to claim 11, wherein said plurality of original detection means are located on said original tray.

13. An image forming apparatus in which, when a first original to be recorded is on a platen, and when a second original succeeds the first original, a first recording sheet corresponds to the second original, and a second recording sheet succeeds the first recording sheet, wherein the second recording sheet is utilized only if it is detected that a further original to be recorded succeeds the second original, said image forming apparatus comprising:

a tray for stacking the originals thereon;

supply means for supplying the originals from said tray downstream in a supply direction toward said platen;

first detection means, for detecting a trail end of a last large-sized original to be supplied by said supply means from said tray toward said platen; and second detection means, disposed downstream in the supply direction from said first detection means, for detecting a trail end of a last small-sized original to be supplied by said supply means from said tray toward said platen.

14. An original supply apparatus, comprising:

an original stacking tray for stacking originals thereon;

separate and supply means for separating the originals on said original stacking tray and supplying separated originals one-by-one to an intermediate position;

convey means for conveying the originals from the intermediate position to a waiting position where the originals await recording;

first detection means disposed at a first position such that, when a last large-size original from said original stacking tray is conveyed by said convey means to the waiting position, a trail end of the last large-size original passes through said first detection means; and second detection means disposed at a second position such that, when a second-from-last original is conveyed by said convey means to the waiting position, a trail end of the second-from-last original passes through said second detection means, but a trail end of a last original on said original stacking tray has not passed through said second detection means.

* * * * *

UNITED STATES PATENT AND TRADEMARK OFFICE

CERTIFICATE OF CORRECTION

PATENT NO. : 5,671,917
DATED : September 30, 1997
INVENTOR(S) : Satoshi CHOHO, et al.

It is certified that error appears in the above-identified patent and that said Letters Patent is hereby corrected as shown below:

Column 1, line 61, after "disposed", insert --at--.

Column 6, line 52, delete "explaining" and insert therefor --explained--.

Column 8, line 28, delete "flaw" and insert therefor --flow--.

Column 9, line 50, delete "An" and insert therefor --A--.

Signed and Sealed this

Thirty-first Day of March, 1998

*Attest:*

Bruce Lehman

BRUCE LEHMAN

*Attesting Officer*

*Commissioner of Patents and Trademarks*